US011602698B2

(12) United States Patent
Skripps

(10) Patent No.: US 11,602,698 B2
(45) **Date of Patent: *Mar. 14, 2023**

(54) TOY SPORTS-PLAYER FIGURE

(71) Applicant: OYO Toys, Inc., Hudson, MA (US)

(72) Inventor: Thomas Keath Skripps, Acton, MA (US)

(73) Assignee: OYO Toys, Inc., Hudson, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/170,328

(22) Filed: Feb. 8, 2021

(65) Prior Publication Data

US 2021/0354042 A1 Nov. 18, 2021

Related U.S. Application Data

(63) Continuation of application No. 14/703,127, filed on May 4, 2015, now Pat. No. 10,913,006, which is a continuation of application No. 13/253,818, filed on Oct. 5, 2011, now Pat. No. 9,022,832.

(60) Provisional application No. 61/389,839, filed on Oct. 5, 2010.

(51) Int. Cl.

| | |
|---|---|
| ***A63H 3/36*** | (2006.01) |
| ***A63H 3/48*** | (2006.01) |
| ***A63H 3/46*** | (2006.01) |
| ***A63H 3/16*** | (2006.01) |

(52) U.S. Cl.

CPC ..... *A63H 3/36* (2013.01); *A63H 3/16* (2013.01); *A63H 3/46* (2013.01); *A63H 3/48* (2013.01)

(58) Field of Classification Search

CPC ... A63H 3/16; A63H 3/20; A63H 3/36; A63H 3/46; A63H 3/48; A63H 13/00; A63H 11/00

USPC ..... 446/321, 330, 337, 340, 376, 378, 383

See application file for complete search history.

(56) References Cited

U.S. PATENT DOCUMENTS

| | | | |
|---|---|---|---|
| 1,746,839 | A | 2/1930 | Main et al. |
| 2,106,148 | A | 1/1938 | Georg |
| 2,669,063 | A | 2/1954 | Wentworth |
| 2,767,516 | A | 10/1956 | Del |

(Continued)

FOREIGN PATENT DOCUMENTS

| | | |
|---|---|---|
| CN | 3441198 | 4/2005 |
| CN | 3586909 | 12/2006 |

(Continued)

OTHER PUBLICATIONS

[No Author Listed], "Bigger LEGO Figures: Taller than Four Bricks," Frog 101, 2019, retrieved from URL: https://blog.minifigures.com/bigger-lego-figures-taller-than-four-bricks/, retrieved on Dec. 29, 2020, 16 pages.

(Continued)

*Primary Examiner* — Joseph B Baldori

(74) *Attorney, Agent, or Firm* — Fish & Richardson P.C.

(57) ABSTRACT

Disclosed herein is a mini-figure that may be used with existing and standard toy block systems and also have the appearance of a sports figure. Improvements over traditional mini-figures include additional separate components in the arms and feet, an optional variation in torso shape, accessories which create visual impression of sports figures in natural use, unique markings identifiable by specific player or production, and a unique method of marketing and distribution.

13 Claims, 42 Drawing Sheets

(56) References Cited

U.S. PATENT DOCUMENTS 2,884,739 A * 5/1959 Ketcham ..... A63H 3/46 446/376
2,959,888 A * 11/1960 Noble ..... A63H 33/065 446/101
3,099,895 A 8/1963 Beebe
3,124,901 A 3/1964 Beebe
3,319,846 A 5/1967 Wolf
3,392,480 A * 7/1968 Stubbmann ..... A63H 33/08 446/101
3,624,960 A 12/1971 Folson et al.
3,650,066 A * 3/1972 Amici ..... A63H 13/14 446/307
2,752,726 A 7/1973 Calverley
3,744,182 A * 7/1973 Terzian ..... A63H 11/06 446/307
3,785,648 A 1/1974 Kobayashi
D231,706 S 5/1974 Christiansen et al.
3,828,467 A 8/1974 Kaelin
3,862,513 A 1/1975 Isaacson et al.
3,874,113 A 4/1975 Beck
3,938,277 A 2/1976 Goldfarb et al.
3,946,517 A 3/1976 Goldfarb et al.
D239,846 S 5/1976 Nygaard
3,955,311 A 5/1976 Lyons et al.
3,962,819 A 6/1976 Christiansen et al.
3,986,295 A 10/1976 Keller
3,995,395 A 12/1976 Rahmstorf
4,063,381 A 12/1977 Deulofeu
4,078,800 A 3/1978 Goldfarb et al.
4,103,451 A 8/1978 Kawada et al.
4,136,481 A 1/1979 Nicholls
D253,711 S 12/1979 Christiansen et al.
4,185,412 A 1/1980 Rahmstorf
4,190,982 A 3/1980 Rahmstorf
4,203,248 A 5/1980 Tapdrup
4,205,482 A 6/1980 Christiansen et al.
4,214,403 A 7/1980 Knudsen
4,235,042 A * 11/1980 Hills ..... A63H 3/14 473/576
4,262,445 A 4/1981 Orsenstein
4,274,224 A 6/1981 Pugh et al.
4,279,419 A 7/1981 Barnes et al.
D278,735 S 5/1985 Nielsen
4,519,786 A 5/1985 Larws
4,580,991 A 4/1986 Renger et al.
4,597,574 A 7/1986 Wolfe
D285,222 S 8/1986 Nakata
4,622,021 A 11/1986 Darrigo
4,623,318 A 11/1986 Tskinopoulos et al.
4,643,691 A 2/1987 Keiji
D290,482 S 6/1987 Ryaa et al.
4,824,414 A 4/1989 Goldblatt
4,894,040 A 1/1990 Bach et al.
4,950,912 A 8/1990 Goldfarb et al.
4,968,282 A 11/1990 Robson et al.
4,988,324 A 1/1991 Ryaa et al.
D317,796 S 6/1991 Laursen
5,049,104 A 9/1991 Olsen
D325,605 S 4/1992 Holmstrom
D329,069 S 9/1992 Holmstrom
D329,070 S 9/1992 Holmstrom
5,181,727 A 1/1993 Fukumura
5,310,380 A 5/1994 Levy et al.
5,322,466 A 6/1994 Bolli
5,340,348 A 8/1994 Schroeder
D350,791 S 9/1994 Refsing
D352,078 S 11/1994 Bertrand
D353,418 S 12/1994 Ryaa et al.
D353,856 S 12/1994 Ryaa et al.
5,376,039 A * 12/1994 Balgin ..... A63H 13/14 446/307
D358,622 S 5/1995 Skov
D366,076 S 1/1996 Pedersen
5,507,678 A 4/1996 Chiang
5,580,295 A 12/1996 Ruzskai et al.
5,588,898 A 12/1996 Ooba
5,628,669 A 5/1997 Hesse
5,690,330 A 11/1997 Ozawa
D387,105 S 12/1997 Thomsen
D389,203 S 1/1998 Glickman et al.
D404,441 S 1/1999 Tong
D408,142 S 4/1999 Song
5,890,944 A 4/1999 Wiggs
5,913,706 A 6/1999 Glickman et al.
D412,946 S 8/1999 Pagel
5,964,635 A 10/1999 Krog
6,012,963 A 1/2000 Lee
D420,064 S 2/2000 Poirier et al.
6,033,284 A 3/2000 Ferre
6,089,950 A 7/2000 Lee et al.
6,098,323 A 8/2000 McGuiness
6,179,685 B1 1/2001 Toft
6,213,839 B1 4/2001 Pedersen
6,247,993 B1 6/2001 Feldman
6,287,166 B1 9/2001 Lee et al.
6,439,952 B1 * 8/2002 Yamamura ..... A63H 3/46 446/376
6,461,217 B1 10/2002 Pestonji
D466,564 S 12/2002 Manville
D472,283 S 3/2003 Akashi
6,554,675 B1 4/2003 Nyengaard
6,572,432 B1 6/2003 Tsai et al.
6,575,810 B1 6/2003 Sohn
6,663,462 B1 12/2003 Bettendorf et al.
6,666,745 B1 * 12/2003 Lund ..... A63H 11/06 446/268
6,679,749 B2 1/2004 Yu
6,692,332 B2 2/2004 Jheow
D494,643 S 8/2004 Bresciani
6,776,682 B2 * 8/2004 Engel ..... A63H 33/40 446/101
6,800,014 B2 10/2004 Dominici et al.
6,817,921 B2 11/2004 Chin et al.
6,893,318 B2 5/2005 Soviknes et al.
D516,135 S 2/2006 Kim
7,182,340 B1 2/2007 Tim
D539,364 S 3/2007 Sofussen
D594,870 S 6/2009 Leung
7,553,209 B1 6/2009 Sorenson
7,665,607 B1 2/2010 Hanan
D611,108 S 3/2010 Bodin
8,308,524 B2 11/2012 deFelice et al.
D680,598 S 4/2013 Torsten
D688,332 S 8/2013 Stosiak et al.
9,022,832 B1 5/2015 Skripps
9,067,147 B1 6/2015 Woodhouse
D738,966 S 9/2015 Chen
9,205,344 B2 12/2015 Botterill et al.
D831,130 S 10/2018 Davis
D873,929 S 1/2020 Hazzard
D879,213 S 3/2020 Hazzard
D887,501 S 6/2020 Zhan et al.
10,913,006 B2 2/2021 Skripps
D927,607 S 8/2021 Skripps
2002/0094750 A1 7/2002 Perse
2003/0162477 A1 8/2003 Jheow
2004/0171328 A1 9/2004 Soviknes et al.
2004/0198161 A1 10/2004 Annis et al.
2005/0112984 A1 5/2005 Hawthorne et al.
2005/0170740 A1 8/2005 Kleinman
2007/0087651 A1 4/2007 Ali
2007/0298676 A1 12/2007 Bookstein
2012/0309257 A1 12/2012 McDonald et al.
2013/0165016 A1 6/2013 Li et al.
2014/0227936 A1 8/2014 Botterill et al.
2015/0306509 A1 10/2015 Skripps
2015/0314209 A1 11/2015 Brooks et al.
2015/0314211 A1 11/2015 Lama et al.
2015/0321109 A1 11/2015 Fukuchi et al.

(56) References Cited

U.S. PATENT DOCUMENTS

FOREIGN PATENT DOCUMENTS

| | | |
|---|---|---|
| CN | 301057680 | 11/2009 |
| CN | 303656156 | 4/2016 |
| CN | 303711692 | 6/2016 |
| CN | 303740338 | 7/2016 |
| CN | 303806688 | 8/2016 |
| CN | 304146203 | 5/2017 |
| CN | 304672947 | 6/2018 |
| CN | 304690194 | 6/2018 |
| CN | 304690195 | 6/2018 |
| CN | 304690198 | 6/2018 |
| CN | 304690208 | 6/2018 |
| CN | 304690209 | 6/2018 |
| CN | 304822190 | 9/2018 |
| CN | 304822191 | 9/2018 |
| CN | 305054682 | 3/2019 |
| CN | 305460255 | 11/2019 |
| CN | 305460257 | 11/2019 |
| CN | 305612054 | 2/2020 |
| EP | 006381562-0002 | 4/2019 |
| EP | 006381562-0001 | 5/2019 |

OTHER PUBLICATIONS

[No Author Listed], "Crazy Arms—Javelin Set," CrazyBricks.com, 2016, retrieved from URL: http://crazybricks.bigcartel.com/product/crazy-arms-javelin-set, retrieved on Dec. 12, 2020, 4 pages.

Thita, "OYO Sports & how it compares to LEGO?," TheBrickBlogger.com, retrieved from URL: http://thebrickblogger.com/2015/02/oyo-sports-how-it-compares-to-lego/, retrieved on Dec. 29, 2020, 9 pages.

US Copyright Registration No. VA655-104, "Basic Minifigures," LEGO Futura Aps, effective Jan. 21, 1994, retrieved on Jan. 6, 2021, 7 pages.

US Copyright Registration No. VA655-230,"Figure with Brown Hair," LEGO Futura Aps, effective Jan. 21, 1994, retrieved on Jan. 6, 2021, 8 pages.

US Trademark Serial No. 2,273,314, registered Aug. 31, 1999, retrieved on Jan. 6, 2021, 2 pages.

US Trademark Serial No. 2,273,321, registered Aug. 31, 1999, retrieved on Jan. 6, 2021, 2 pages.

US Trademark Serial No. 2,922,658, registered Feb. 1, 2005, retrieved on Jan. 6, 2021, 1 page.

US Trademark Serial No. 4,903,968, registered Feb. 23, 2016, retrieved on Jan. 6, 2021, 2 pages.

* cited by examiner

PLAYER STATS

| YEAR | AB | AVG | BB | H | HR | 3B | 2B | 1B | R | E |
|---|---|---|---|---|---|---|---|---|---|---|
| 2007 | 50 | 0.5 | 5 | 25 | 1 | 2 | 2 | 20 | 9 | 2 |
| 2008 | 50 | 0.5 | 5 | 25 | 1 | 2 | 2 | 20 | 9 | 2 |
| 2009 | 50 | 0.5 | 5 | 25 | 1 | 2 | 2 | 20 | 9 | 2 |
| 2010 | 50 | 0.5 | 5 | 25 | 1 | 2 | 2 | 20 | 9 | 2 |

Fig. 26
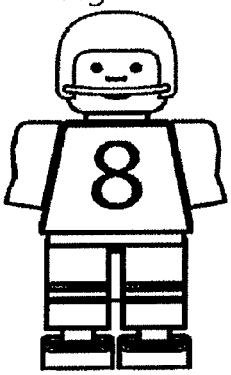
Fig. 27
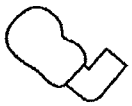
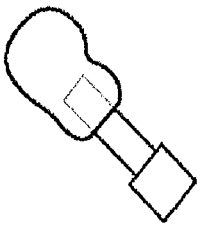
FIG. 30
Fig. 28
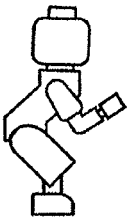
Fig. 29
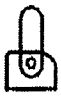
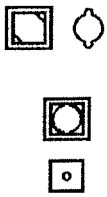
FIG. 31
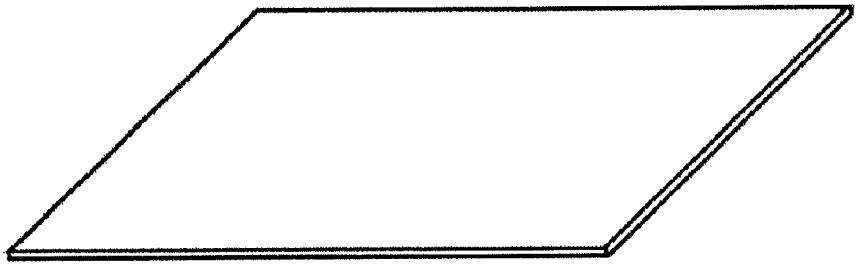
FIG. 32
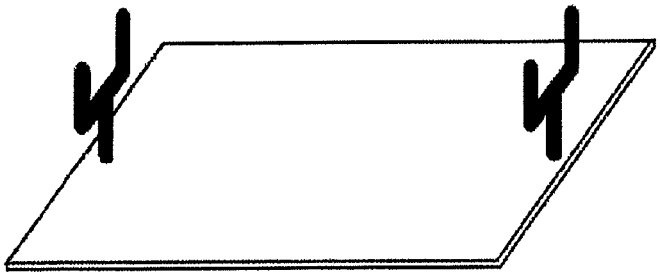
FIG. 33

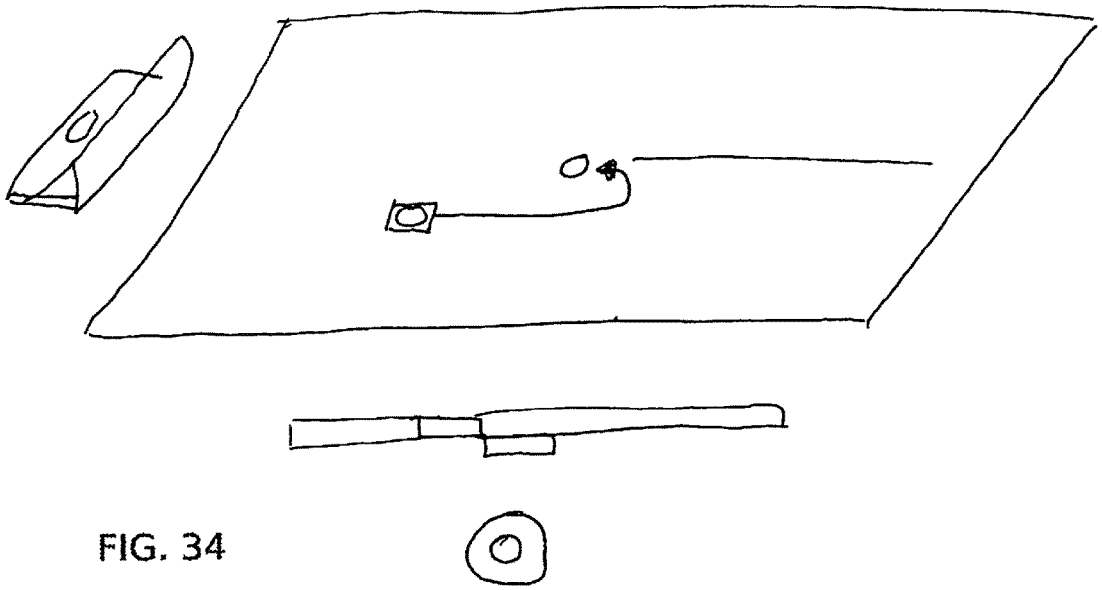
FIG. 34
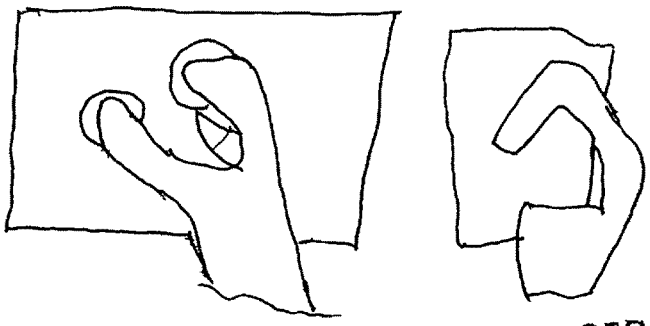
FIG. 35A
FIG. 35B

⚠ VARIABLE RADIUS: TRANSITION FROM R.040 TO .005 TO .040

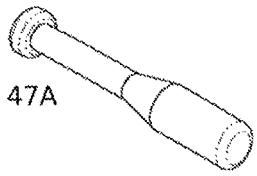
FIG. 47A
FIG. 47B
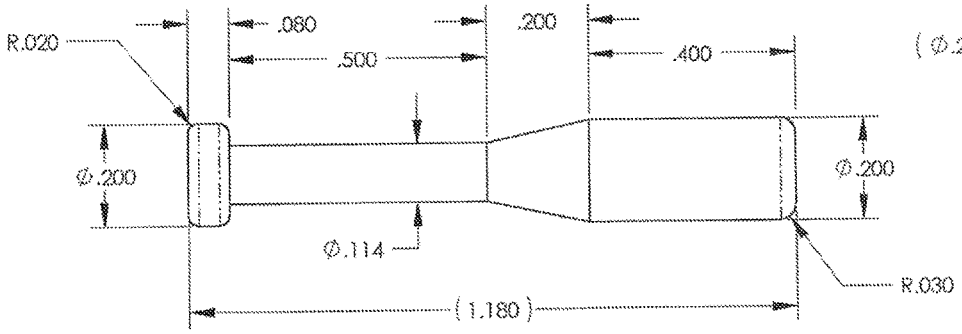
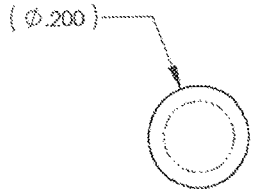
FIG. 47C

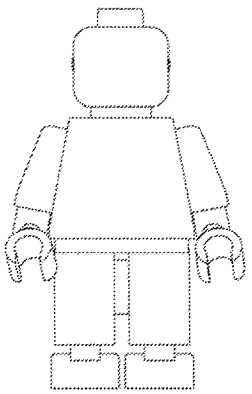
FIG. 60A
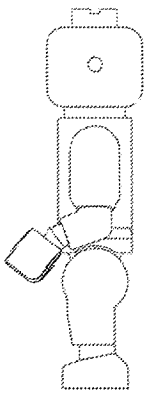
FIG. 60B
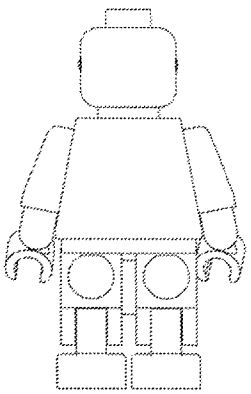
FIG. 60C
FIG. 60D
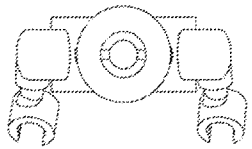
FIG. 60E
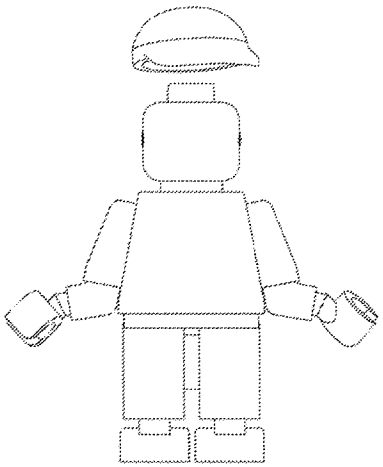
FIG. 60F
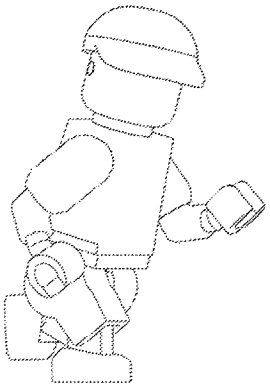
FIG. 60G
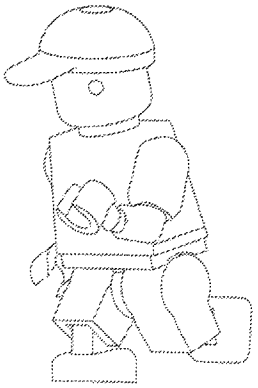
FIG. 60H

TOY SPORTS-PLAYER FIGURE

CROSS-REFERENCE TO RELATED APPLICATIONS

This application is a continuation application of and claims priority to U.S. application Ser. No. 14/703,123, filed on May 4, 2015, now U.S. Pat. No. 10,913,006, which is a continuation of U.S. application Ser. No. 13/252,818, filed on Oct. 5, 2011 now U.S. Pat. No. 9,022,832, which claims priority to U.S. Application No. 61/389,839, filed Oct. 5, 2010 and titled "TOY SPORTS-PLAYER FIGURINE," each of which is incorporated in its entirety by reference herein.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Copyright 2011, Oyo Sportstoys, Inc.

BACKGROUND

Field of the Disclosure

The disclosure relates to toys, and more specifically to toy mini-figures depicting sports figures and connectable to toy construction block playsets.

Background

Toy construction block mini-figures come in many sizes and shapes. A standardized size and shape has been established by dominance of Lego brand blocks. A standard block, and connector type, allows manufacture of mini-figures for use with the standard block and connector for ready acceptance by consumers. Typically mini-figures are marked as components with painted features in component batches, and assembled into the desired mini-figure by selecting the appropriate component.

Legos and similar building blocks are long existing toys. Initial figurines were scaled to connect to a single tab on the blocks. At that scale, no moving parts were includes, but rather single "blocks" were decorated to appear as figurines.

The original Lego mini-figure can be seen in U.S. Design Pat. No. D253,711 (Christiansen et al., Dec. 18, 1979) and U.S. Pat. No. 4,205,482 (Christiansen et al., Jun. 3, 1980). These mini-figures, about 1.5 inches tall, include a head attached to a torso component, two arm components which pivot at the connection to the torso in the shoulder region, a hip component connected to the bottom of the torso, and two leg components connected to and pivotal from the hip component. Feet are part of the bottom of the legs, with recesses or channels in the back of the legs and bottom of the feet allowing connection to studs from building blocks. Curved hand components extend out of each arm. To create different character mini-figures, different designs, stickers, or coloring may be affixed to different components. Assembling different sets of components based on the same theme may create the appearance of specific characters. Accessories may be held in the hands or connect to the head, such as weapons, tools, hair, hats, or helmets.

Variations have been introduced since the original mini-figure. Larger figures have been created. Themed figures have been created. Specialized components have been created for specific creatures, such as an empty-skeleton torso and related arms and legs for a skeleton. However the shape and points of motion of the mini-figure has largely remained unchanged. This is largely due to the durability and scale needed.

BRIEF SUMMARY

Disclosed herein is a mini-figure that may be used with existing and standard toy block systems and also have the appearance of a sports figure. Improvements over traditional mini-figures include additional separate components in the arms and feet, an optional variation in torso shape, accessories which create visual impression of sports figures in natural use, unique markings identifiable by specific player or production, and a unique method of marketing and distribution.

An embodiment includes creation of the arm through two components—a shoulder component and a forearm component. The shoulder component may connect to the torso as traditional arms of mini-figures connect. The forearm may connect to the shoulder such that the forearm may pivot at the connection. This allows two points of motion for an arm, allowing hands connected to both arms to come into alignment such as for holding a baseball bat in a traditional baseball grip.

An embodiment includes a foot component which is connectable to and a leg and may pivot from that connection. Separation into a separate foot component allows positioning into active poses by bending at both the ankle and waste, such as creation of a running pose or batting stance, while still allowing the feet to rest on a flat surface or connect to traditional tabs on toy blocks.

Optional embodiments include variation of the traditional torso component. The torso may be made from multiple separable components, such as for creation of cheerleaders with variable outfits. Alternatively the torso may have a natural bend depicting typical sports stance, such as may be seen in hockey players.

Sports accessories may be included with sports mini-figures, or included on components of the mini-figures. For example, balls, gloves, and sticks may be included. Stick-like accessories may include narrow regions for grip by hands. Balls and gloves, which traditionally are not grippable by mini-figures, may have one side specifically shaped to fit with traditional mini-figure hand shapes. This allows sports figures to hold their appropriate accessories. In addition to separate pieces, separation of arms and feet allows further customization. For example, shoulder pads may be included on shoulder component and vary by sport, and sport-specific shoe designs may be included on foot components. This allows further customization by component than is possible with single arm or combined foot and leg components.

An embodiment includes unique markings on one or more components in each mini-figure. Mini-figures are traditionally mass produced, but individualization by sets or other indicia allows increased commercial value and collectability of specific mini-figures.

Along with specific marking, vending machine or interactive displays may be used to distribute mini-figures and increase commercial appeal.

BRIEF DESCRIPTION OF THE DRAWINGS

In the drawings, closely related figures and items have the same number but different alphabetic suffixes. Processes, states, statuses, and databases are named for their respective functions.

FIG. 26 shows a football player mini-figure.

FIG. 27 shows an arm of a football player mini-figure with pads and muscles.

FIG. 28 shows a hockey player mini-figure.

FIG. 29 shows a bending forearm component.

FIG. 30 shows a foot component designed to appear as a hockey skate.

FIG. 31 shows a magnetic insert that fits into a foot component.

FIG. 32 shows a magnetic surface.

FIG. 33 shows a magnetic surface appearing to be a football field.

FIG. 34 shows a virtual/real playing surface having controlled locations of magnetic position, with magnets also shown having a magnetic core surrounded by a buffer zone.

FIG. 35A and FIG. 35B show touch-based controls of the magnetic playing surface.

FIG. 38A shows a perspective view, FIG. 38B shows a top-down view, FIG. 38C shows a wide-side view; FIG. 38D shows a bottom-up view, and FIG. 38E shows a narrow-side view.

FIG. 39A shows a perspective view, FIG. 39B shows a side view of the component laid flat, FIG. 39C shows a view looking into the hand-side end, FIG. 39D shows a side view of the component tilted up. and FIG. 39E shows an interior slice view.

FIG. 40A shows a perspective view, FIG. 40B shows an end view, FIG. 40C shows top view, FIG. 40D shows a side view, and FIG. 40E shows an interior slice view.

FIG. 41A shows a perspective view, FIG. 41B shows a side view, FIG. 41C shows a close up view of the connector the enters the torso component, FIG. 41D shows torso-side view, and FIG. 41E shows a forearm-end view.

FIG. 42A shows a perspective view, FIG. 42B shows a top view, FIG. 42C shows a back view, FIG. 42D shows a side view, FIG. 42E shows an interior slice view, and FIG. 42F shows a close-up view of the ear.

FIG. 43A shows a perspective view, FIG. 43B shows a top view, FIG. 43C shows a front view, and FIG. 43D shows a side view.

FIG. 44A shows a perspective view, FIG. 44B shows a bottom view, FIG. 44C shows an interior slice view from the side, FIG. 44D shows a side view, FIG. 44E shows an interior slice view from the front, FIG. 44F shows a back view.

FIG. 45A shows a perspective view, FIG. 45B shows a bottom view, FIG. 45C shows a side view, FIG. 45D shows a front view, FIG. 45E shows an interior slice view, and FIG. 45F shows another interior slice view.

FIG. 46A shows a perspective view, FIG. 46B shows a bottom view, FIG. 46C shows a side view, FIG. 46D shows an interior slice view, and FIG. 46E shows a back view.

FIGS. 47A-C show multiple views of a bat accessory. FIG. 47A shows a perspective view, FIG. 47B shows a side view, and FIG. 47C shows a top view.

FIG. 48A shows a perspective view, FIG. 48B shows a top view, FIG. 48C shows a side view, FIG. 48D shows a bottom view, FIG. 48E shows a front view, and FIG. 48F shows an interior slice view.

FIG. 49A shows a perspective view, FIG. 49B shows a top view, FIG. 49C shows a side view, FIG. 49D shows a back view, and FIG. 49E shows an interior slice view.

FIG. 50A shows a perspective view, FIG. 50B shows a top view, FIG. 50C shows an interior slice, and FIG. 50D shows another interior slice on a different axis.

FIG. 51A shows a perspective view, FIG. 51B shows a top view, FIG. 51C shows a side view, FIG. 51D shows a front view, and FIG. 51E shows an interior slice view.

FIGS. 60A-H shows multiple perspective views of a mini-figure with multi-component arms and separate component legs and feet. FIG. 60A shows a front view, FIG. 60B shows a side view, FIG. 60C shows a back view, FIG. 60D shows a bottom view, FIG. 60E shows a top view, FIG. 60F shows a front view with forearm rotated away from the mini-figure, FIG. 60G shows a running perspective, and FIG. 60H shows a running perspective from the other side.

FIGS. 64A-1 show multiple perspective views of a glove accessory.

DETAILED DESCRIPTION OF THE INVENTION

In the following detailed description of the invention, reference is made to the accompanying drawings which form a part hereof, and in which are shown, by way of illustration, specific embodiments in which the invention may be practiced. It is to be understood that other embodiments may be used, and structural changes may be made without departing from the scope of the present invention.

A preferred embodiment is a mini-figure with improvements over traditional mini-figures allowing more accurate appearance and positioning creating a sports mini-figure. Such improvement is enabled through arm, leg, torso, and accessory features.

Figure 1:
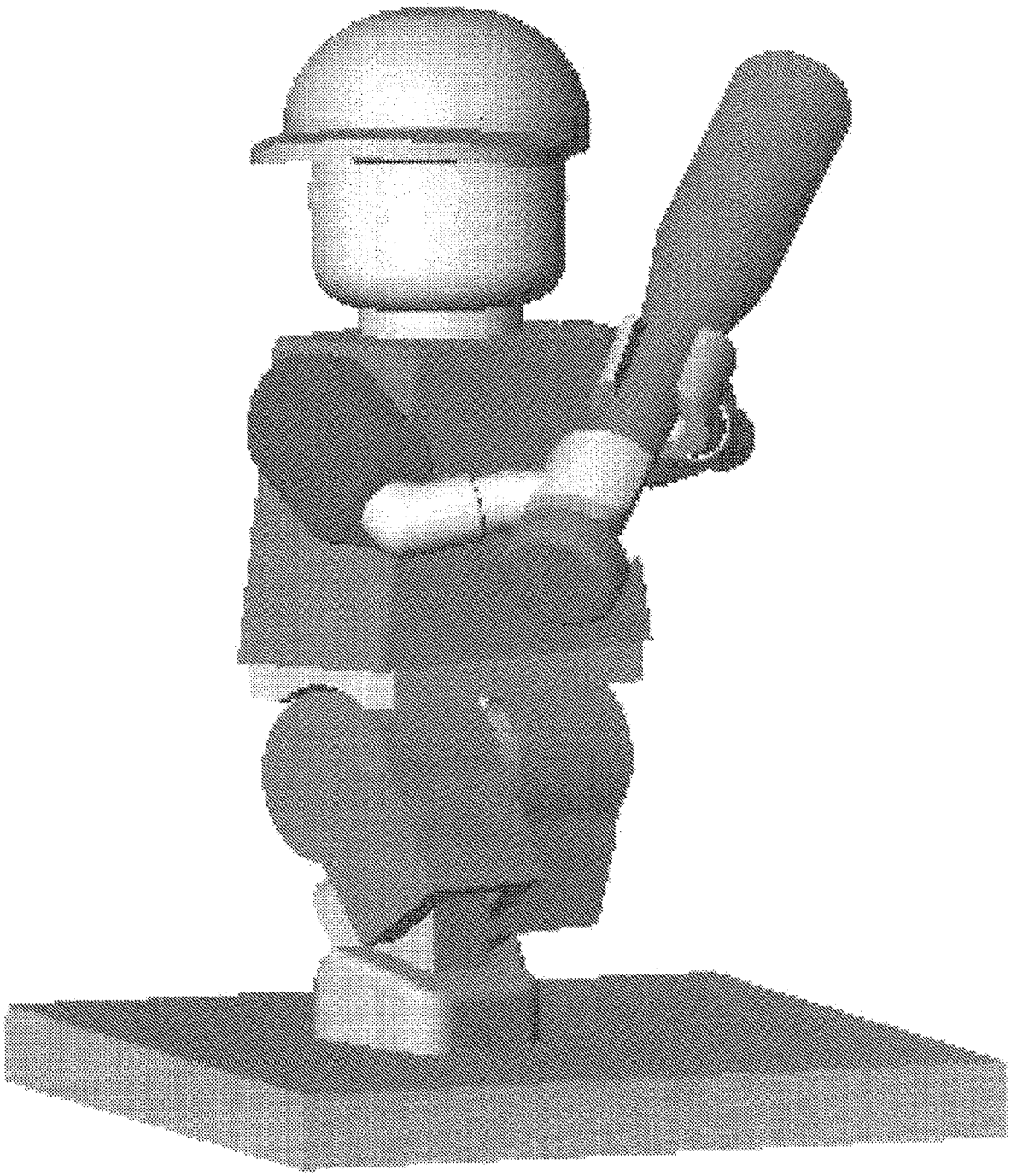
FIG. 1 shows a sports mini-figure holding a bat and connected to a display plate.
Figure 2A:
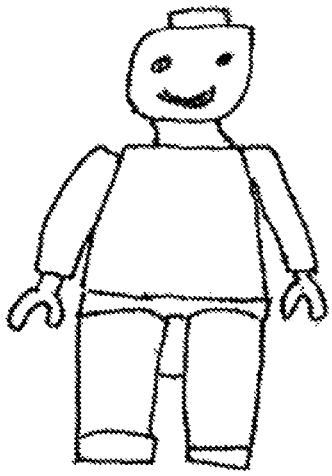
FIG. 2A shows a traditional mini-figure and FIG. 2B shows a mini-figure having multi-component arms and separate-component feet, with relative heights approximately equal between both mini-figures.
Figure 2B:
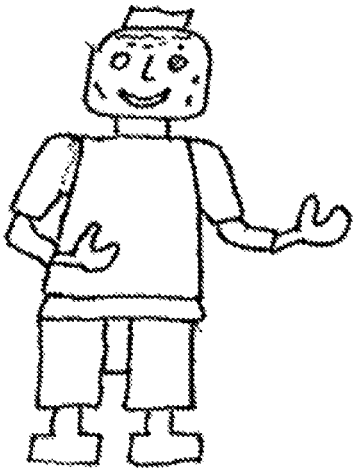

Referring to FIG. 1, a baseball mini-figure is shown holding a bat in a batting position. Such arrangement is not possible with prior mini-figures, as the hands could not be positioned near to each other or across the body to hold a bat as in a baseball bat grip, nor do prior mini-figures bend at an ankle level to allow athletic-looking stances such as a the shown batting stance. Despite these differences, the improved sports mini-figure may be used with prior playsets as if it were a prior mini-figure, and connect to building block tabs the same as prior mini-figures. Referring also to FIG. 2, the improved sports mini-figure is shown to be of the same scale and overall general appearance as a prior mini-figure. In the preferred embodiment, the height of the improved sports mini-figure is approximately 1.56 inches.

Figure 3:
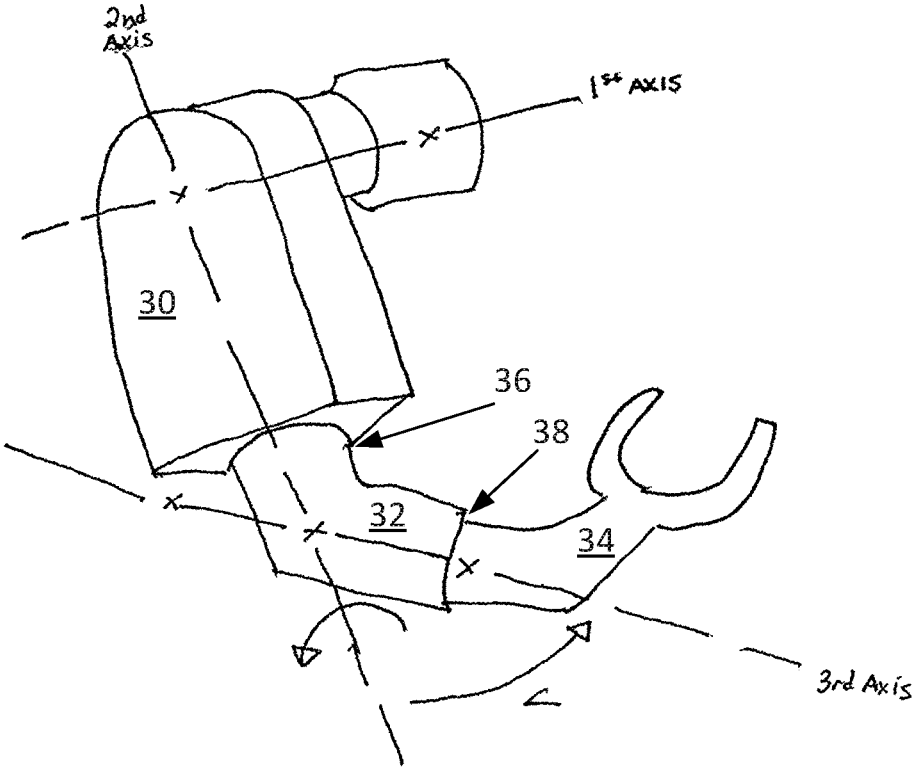
FIG. 3 shows a shoulder component connected to a forearm component connected to a hand component with axis of rotation illustrated.
Figure 4:
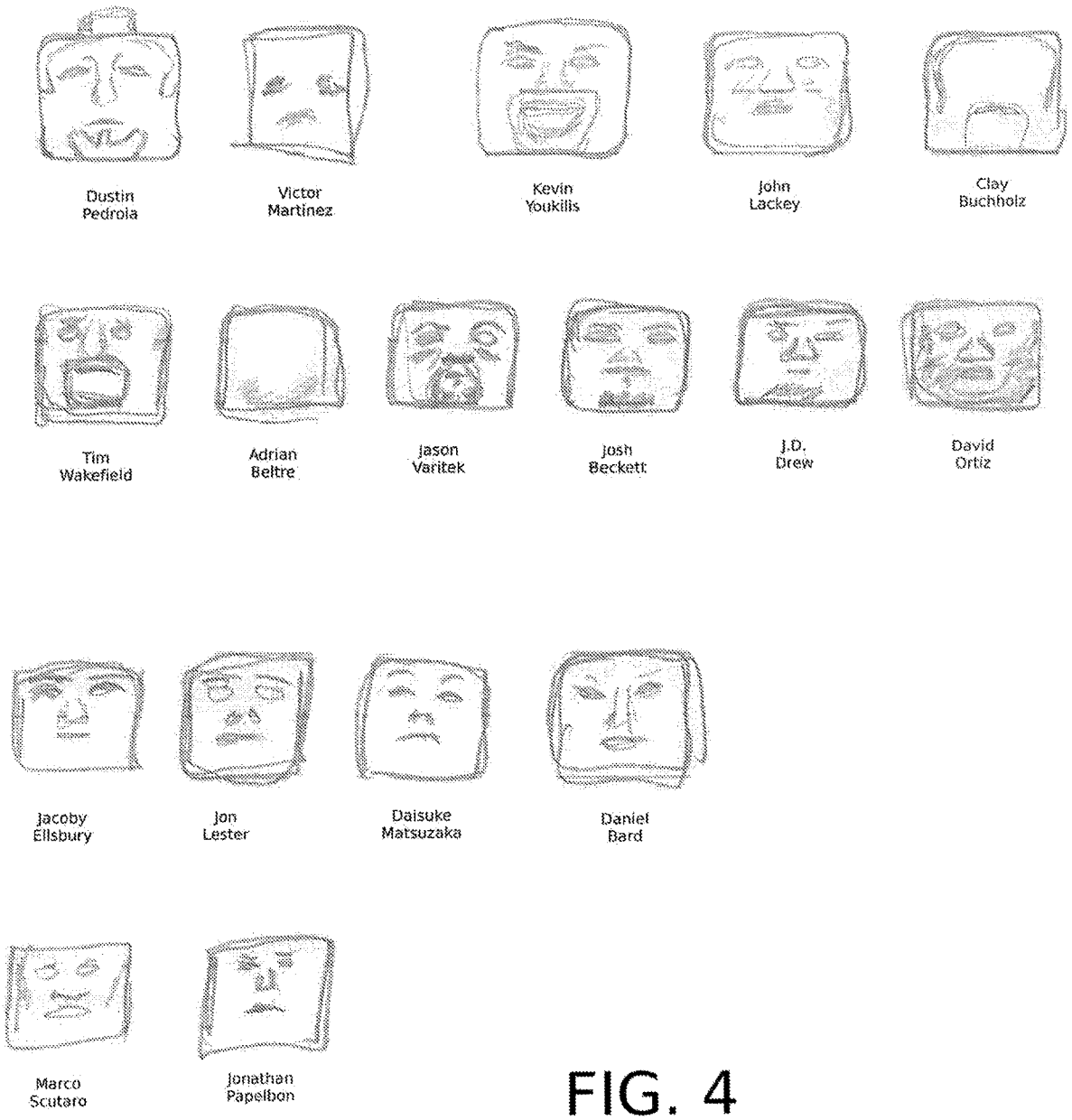
FIG. 4 shows a set of facial designs for head components, in this case a set of baseball players from the same baseball team.
Figure 5:
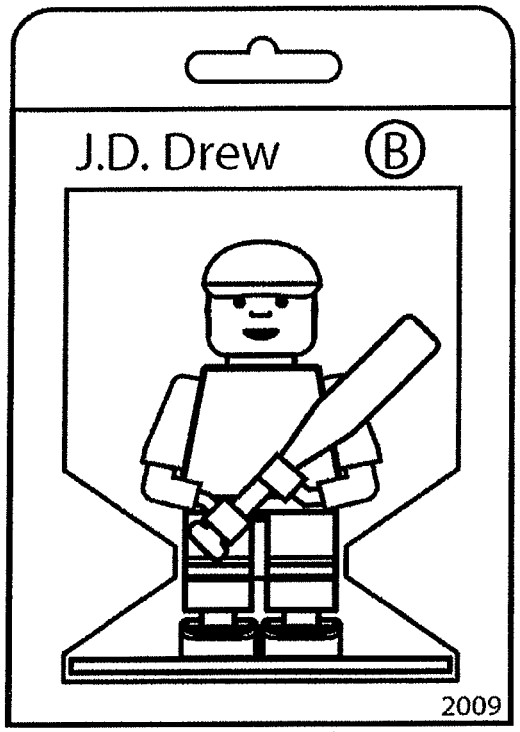
FIG. 5 shows a mini-figure with display plate in a distribution box for display purposes.
Figure 6:
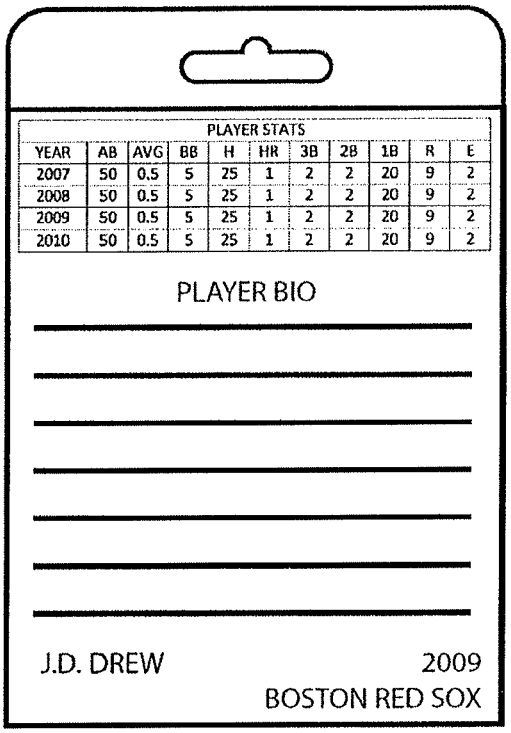
FIG. 6 shows the back of a distribution box.
Figure 7:
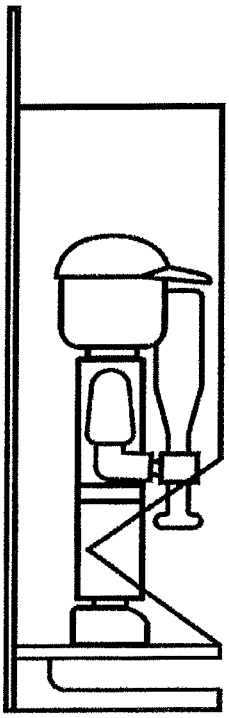
FIG. 7 shows a side view of the distribution box illustrating a clamp-shell design allowing a mini-figure and display plate to be packaged together, including holding the mini-figure in assembled position or stance.

Referring also to FIG. 3, a complete arm is shown. The complete arm includes three components, an upper arm or shoulder component 30 (see also FIG. 41), a forearm component 32 (see also FIG. 39), and a hand component 34 (see also FIG. 40). The upper arm component 30 connects to the torso, where the connection may be the same as in prior mini-figures, allowing the arm to pivot in a plane adjacent to the side of the torso. The forearm component 32 connects to the upper arm component 30 through an interference-fitted cylindrical connection 36. The forearm component 32 may be bent at an angle just below the end of connection to the upper arm component 30. This provides appearance of a bent elbow. The lower arm 32 may rotate about an axis parallel to the upper arm 30 and defined by a line between the shoulder of the upper arm 30 and elbow of the forearm 32. This second point of rotation allows the forearm 32 to be positioned across or away from the body of a mini-figure. The hand component 34 connects to the forearm 32 through an interference-fitted cylindrical connection 38, which may be the same as in prior mini-figures. Inward reach and ability to align hands is enabled by the additional point of rotation and allows the mini-figure to hold a bat in a traditional batting grip or hold sports equipment in both hands in traditional positions associated with the sport.

Referring also to FIGS. 44, 45, and 46, a foot component may be connected to each leg component allowing pivot of the foot up or down while still aligned straightforward relative to the leg. This allows a point of rotation additional to leg rotation at the hip. This additional point creates a visual appearance of an ankle or knee (a lower-leg point of rotation). This in turn allows positioning into traditional athletic poses, such as a baseball player squatting into a batting stance, a player running, or a pitcher striding to throw. The bottom of the foot component has a recess designed to accept tabs from traditional building blocks, allowing connection of the sports mini-figure to the building block through the foot.

Figure 21:
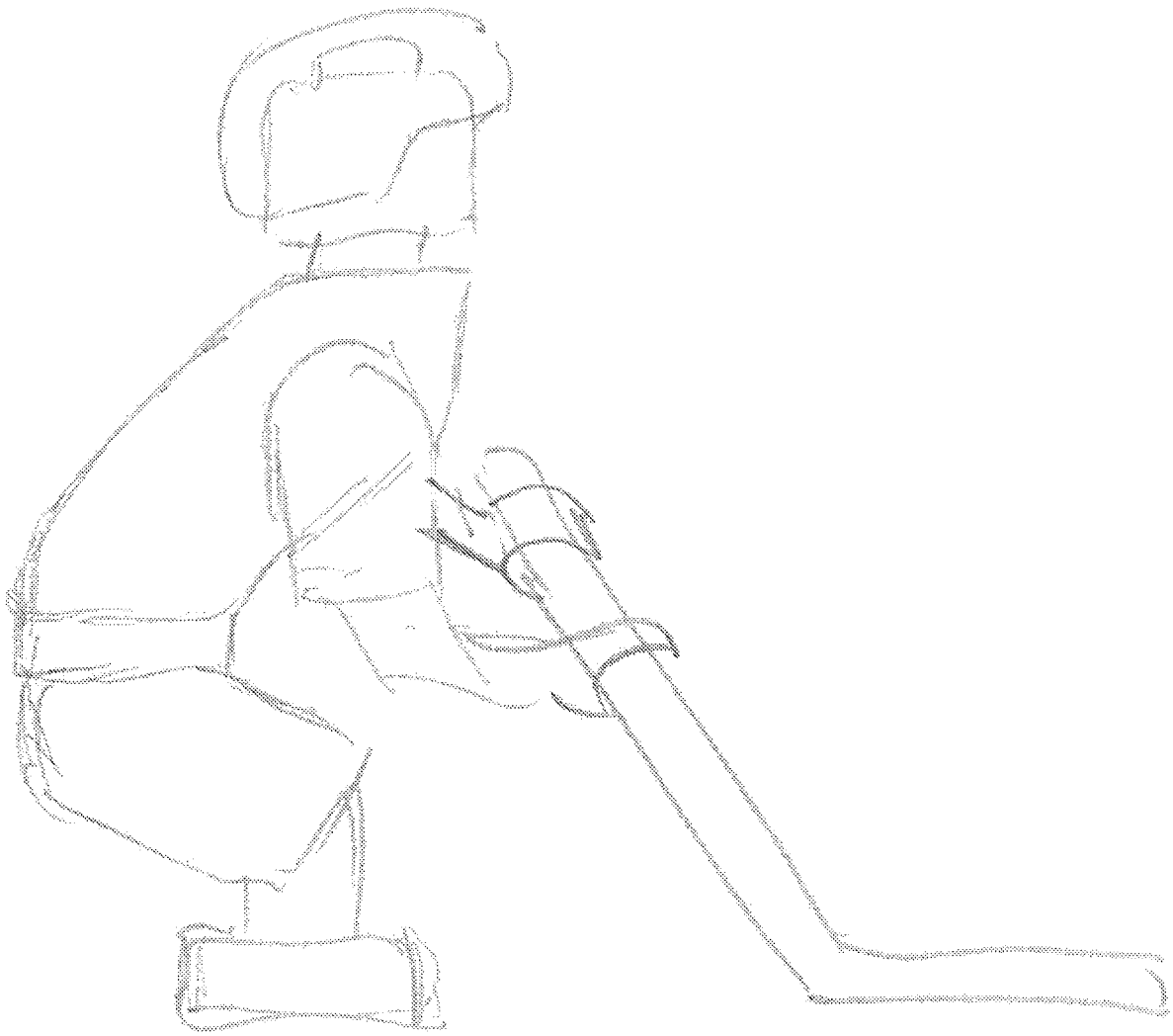
FIG. 21 shows a hockey mini-figure with angled torso.
Figure 22:
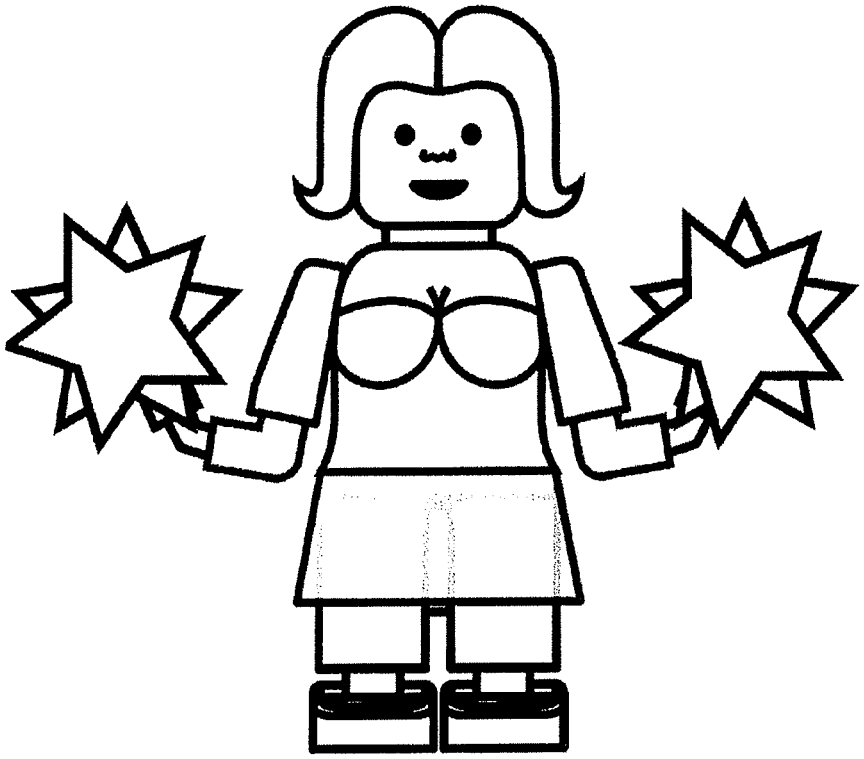
FIG. 22 shows a cheerleader mini-figure.
Figure 23:
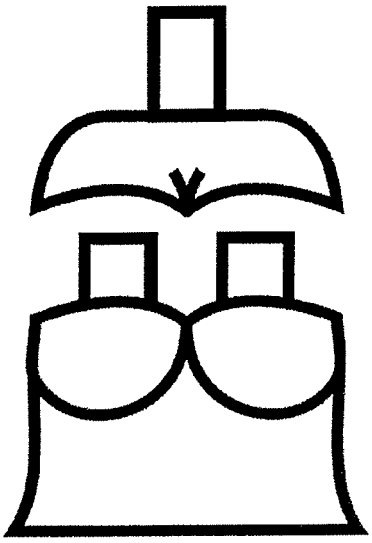
FIG. 23 shows a cheerleader torso separated into two components.

Referring also to FIGS. 21, 22, and 23, some embodiments may include variations in the torso component. A skating hockey player has a traditional bent upper body position. This may be implemented by a torso component having an angled position to the axis of rotation of the head. Alternatively, cheerleaders may be created with non-traditional torso components. The torso component may be comprised of two separate components, allowing an upper chest and lower torso. This allows more accurate mini-figure depiction of cheerleaders, including bikini top, cleavage, skinny waist. Delineation of the torso portions may be either above or below the breasts, but should be consistent across mini-figure cheerleaders to allow consistent swapping of torso sub-components.

Sports accessories may be included with sports mini-figures, or included on components of the mini-figures. Baseball bats, hockey sticks, lacrosse sticks, and other sports equipment may be included. Due to the flexible arm posing enabled by multi-segment arms, bats and sticks may have regions for gripping by the mini-figure hands that correspond to where real-life athletes would grip the bat or stick. Sports balls, gloves, and cheerleading equipment may also be made into accessories. One or two-handed accessories, which traditionally are not grippable by mini-figures, may have one side specifically shaped to fit with traditional mini-figure hand shapes. This allows sports figures to hold their appropriate accessories. Referring to FIGS. 14-20, a baseball glove, baseball, and football are shown with recesses on one side of each accessory allowing fit with mini-figure hands. Such cylindrical cut into the accessory allows interference fit with a hand to hold the accessory and present appearance of the object. Accessories which go together, such as a baseball and glove, may also be sized for interference fit such that the ball may fit and hold within the glove. Referring also to FIGS. 26, 27, 28, and 33, accessories may also be designed onto mini-figure components. For example, shoulder pads may be designed as part of upper-arm components for football players. Different tattoo design may be included in upper-arm components for different basketball players. Ice skates may be designed as part of foot components for hockey players. Different sneaker design may be designed as part of foot components for different athletes. This allows finely tuned specifics of more components, allowing more customization of individual mini-figures than previously possible.

Referring also to FIG. 30, an additional accessory may be a magnetic component which fits into the recess in a foot component. The magnetic component may include a cavity to enable easy removal. Inclusion of the magnetic component enables the mini-figure to secure stably to a flat surface in a standing or athletic position as long as the foot is flat on the surface. Referring also to FIGS. 31 and 32, the surface may be magnetic, and may be shaped and marked as an athletic performance venue such as a sports field, court, or rink. The surface may have localized magnetic positions to allow a player to be restrained or controlled by the location of the magnetic feature. Referring also to FIGS. 33 and 34, moving the magnetic feature may allow the mini-figure to move on the surface, and may be controlled by a user interface.

Figure 8A:
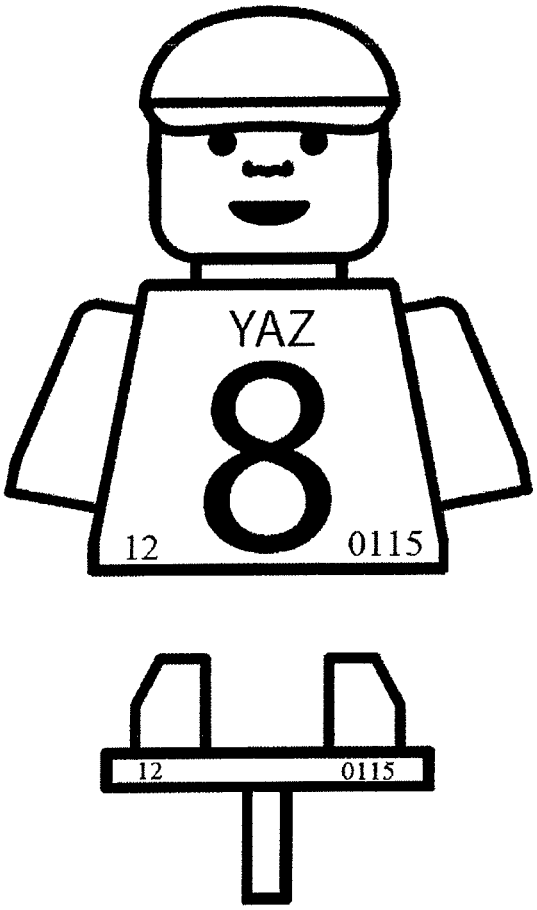
FIG. 8A shows serialized markings on multiple components of a mini-figure, each component bearing the same serialized set number.
Figure 8B:
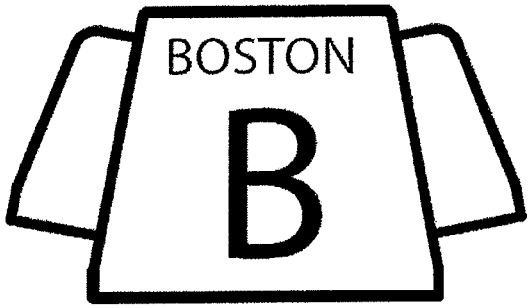
FIG. 8B depicts a printing or label customized for a specific player and component.
Figure 9:
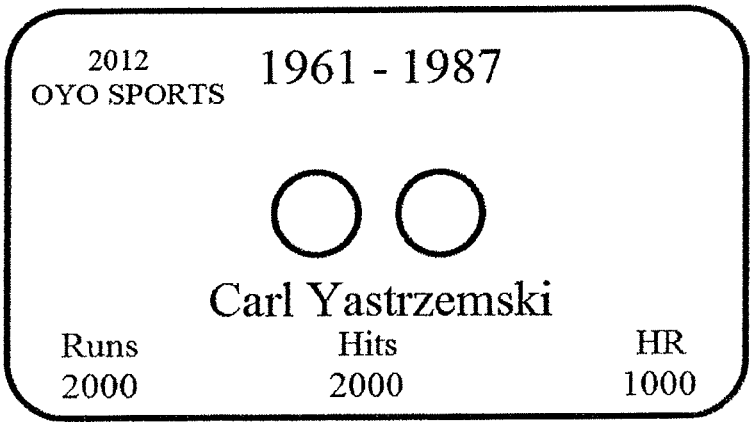
FIG. 9 shows a display plate with sports-related information associated with a specific player.
Figure 10:
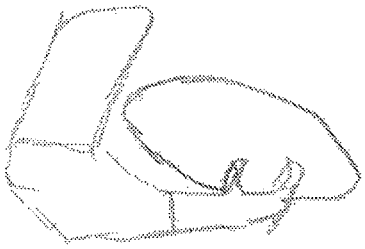
FIG. 10 shows an arm with the hand component holding a football accessory.
Figure 11:
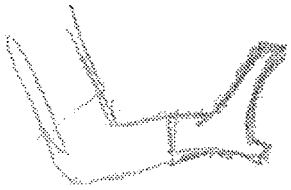
FIG. 11 shows an arm in a stiff-arm block position.
Figure 12:
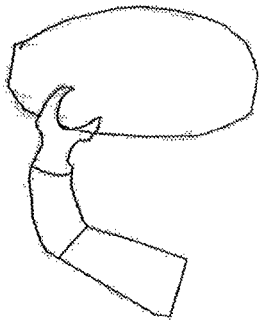
FIG. 12 shows an arm holding a football accessory in a throwing position.
Figure 13:
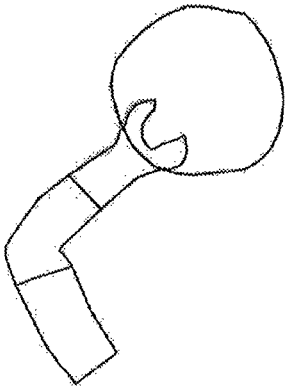
FIG. 13 shows an arm holding a baseball accessory in a throwing position.
Figure 14:
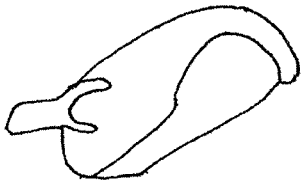
FIG. 14 shows a baseball glove accessory.
Figure 15:
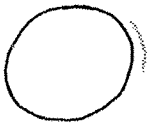
FIG. 15 shows a baseball accessory sized to fit in the baseball glove accessory of FIG. 14.
Figure 16:
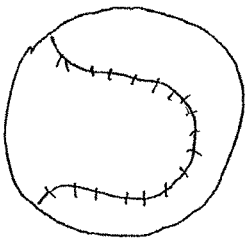
FIG. 16 shows a baseball accessory.
Figure 19:
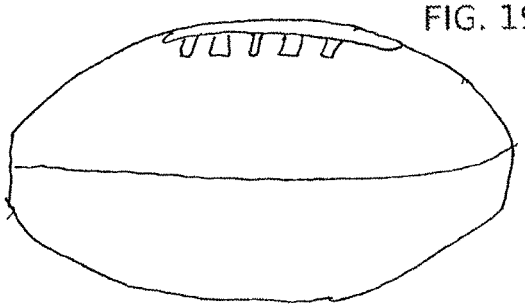
FIG. 19 shows a football accessory.
Figure 17:
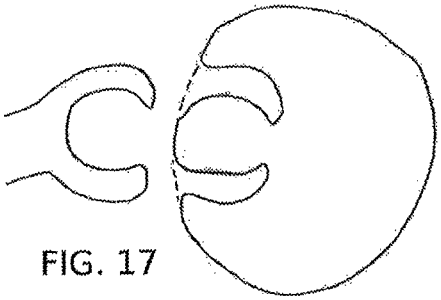
FIG. 17 shows a baseball rotated to reveal a grip nestable within the hand of a mini-figure.
Figure 20:
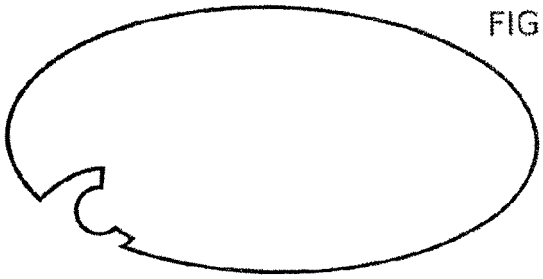
FIG. 20 shows a football rotated to reveal a grip nestable within the hand of a mini-figure.
Figure 18:
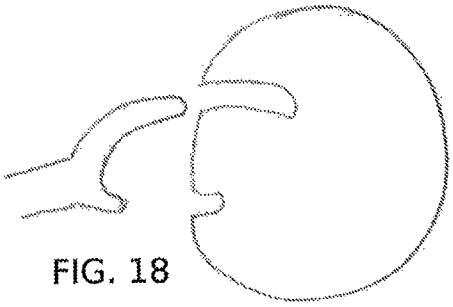
FIG. 18 shows a baseball with the grip partially complete.
Figure 36:
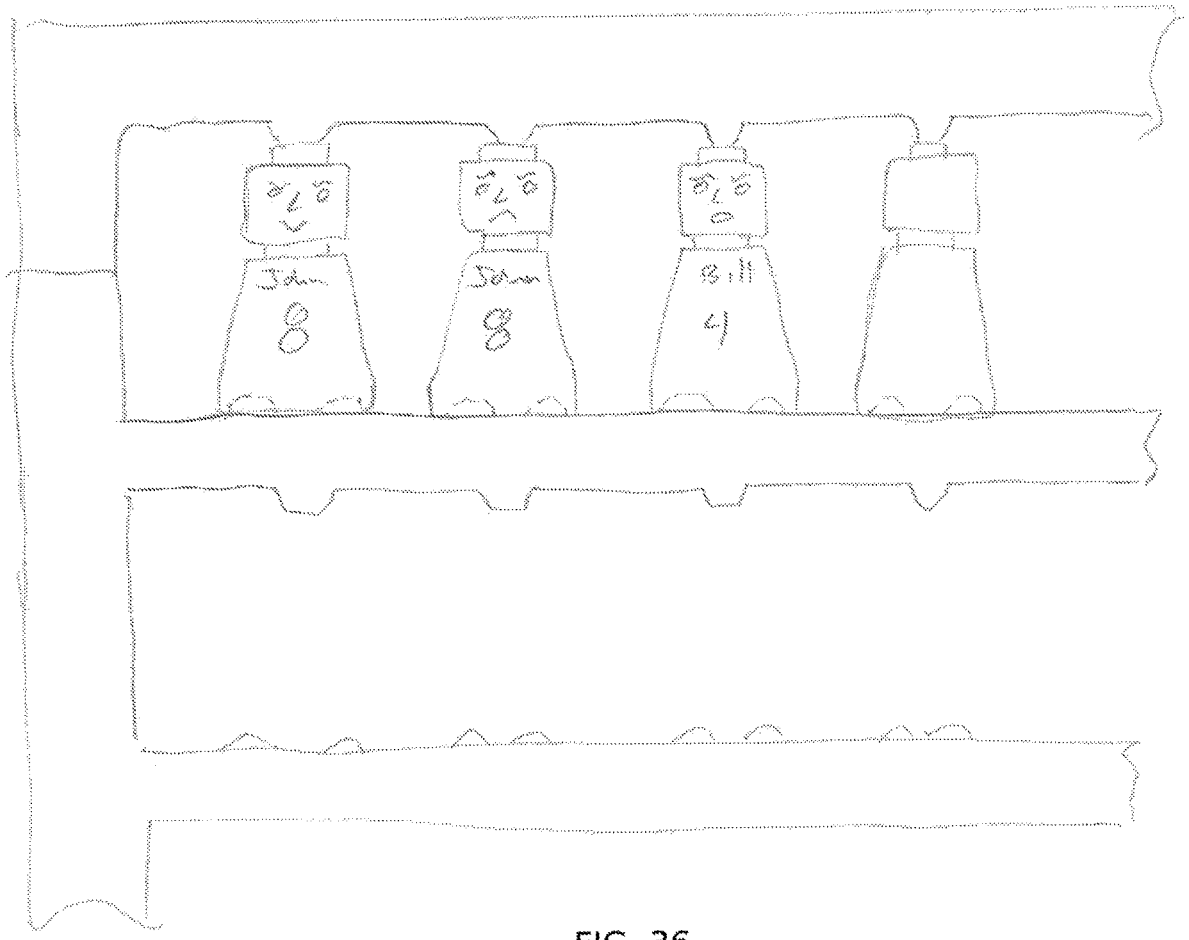
FIG. 36 shows multiple stations for holding and variably printing mini-figure components.
Figure 37:
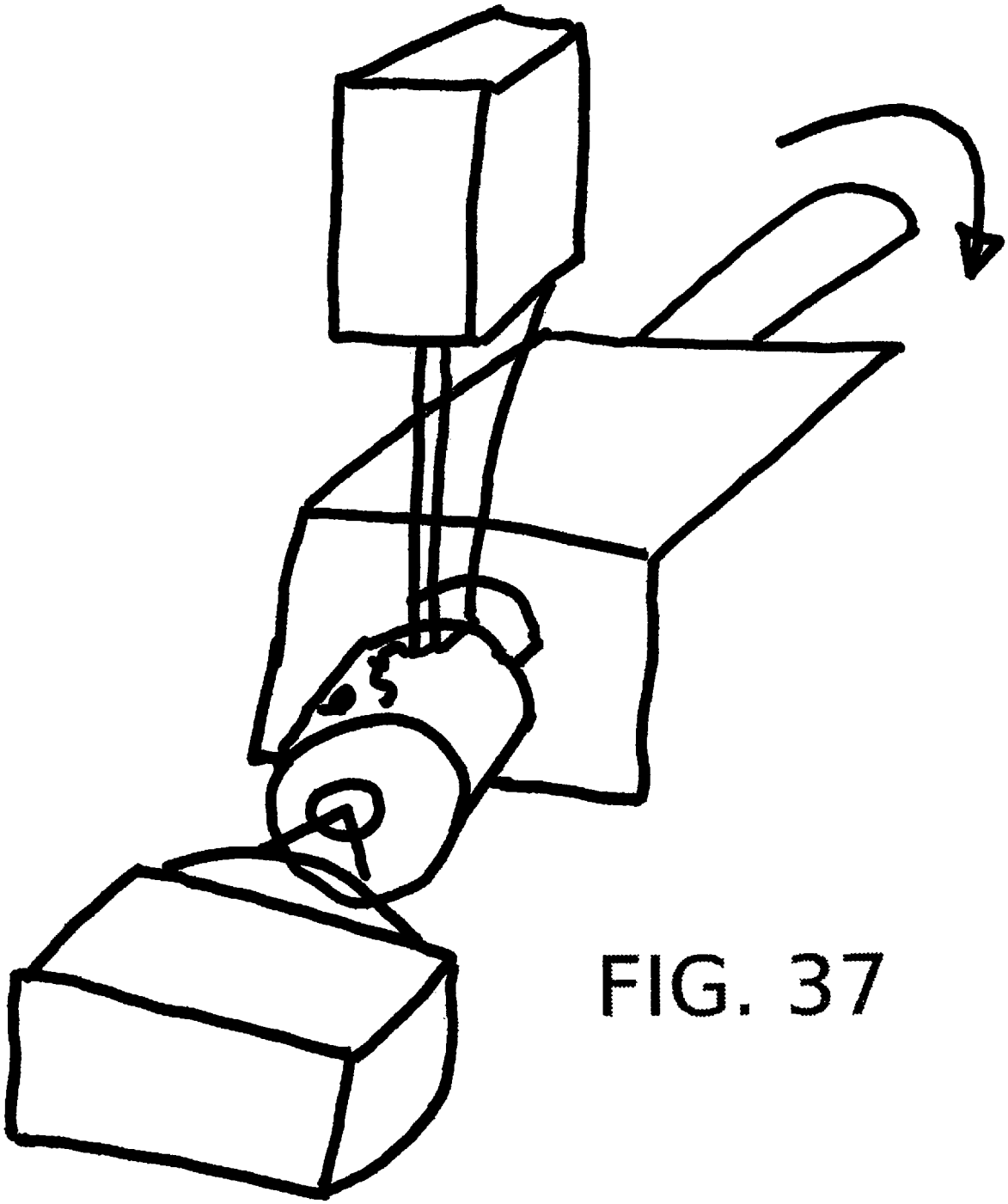
FIG. 37 shows a rotational printing station for printing on mini-figure heads.
Figure 38A:
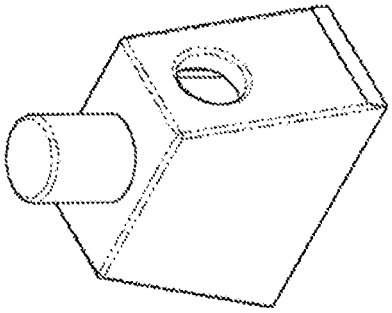
FIGS. 38A-E show multiple views of a torso component.
Figure 38E:
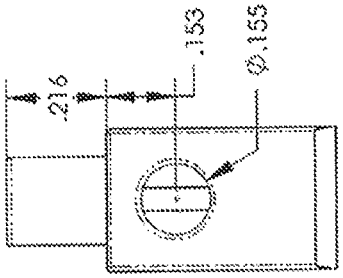
Figure 38B:
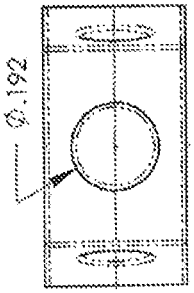
Figure 38C:
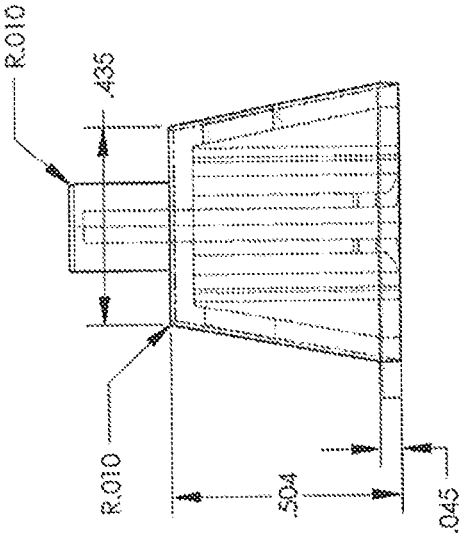
Figure 38D:
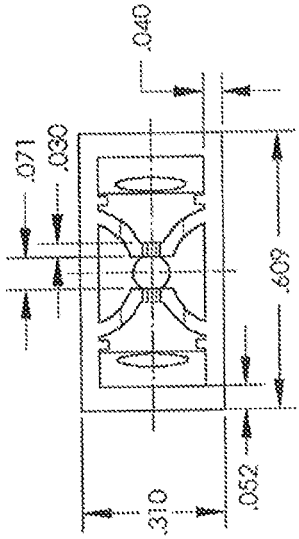
Figure 39A:
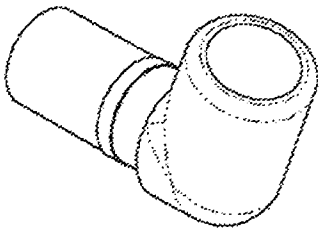
FIGS. 39A-E show multiple views of a forearm component.
Figure 39E:
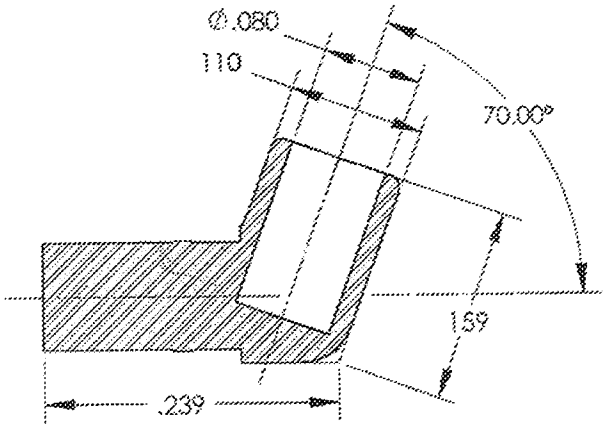
Figure 39B:
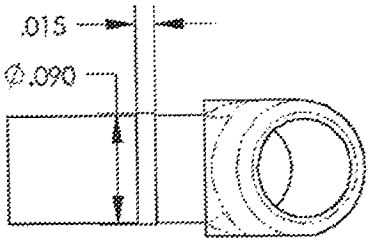
Figure 39D:
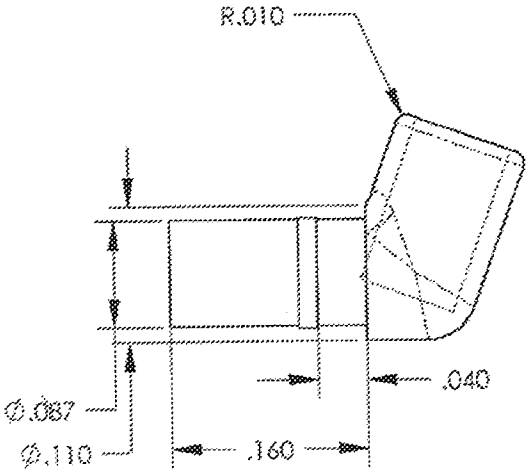
Figure 39C:
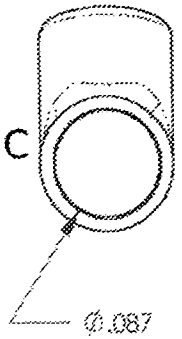
Figure 40B:
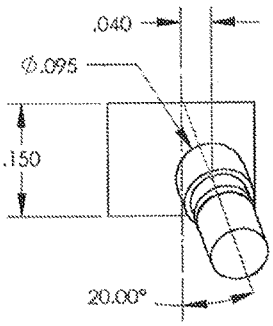
FIGS. 40A-E show multiple views of a hand component.
Figure 40A:
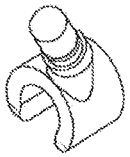
Figure 40E:
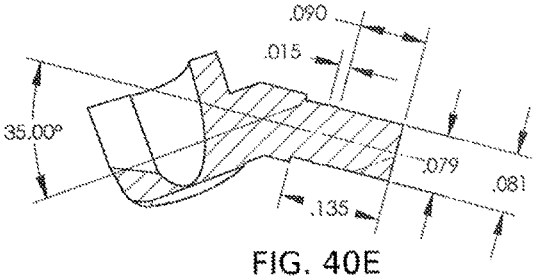
Figure 40C:
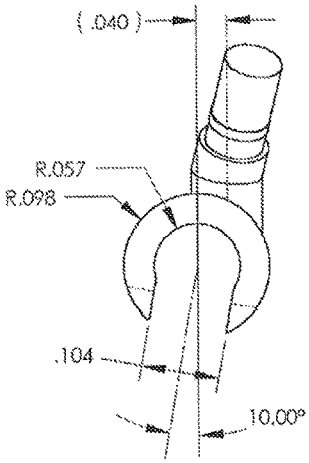
Figure 40D:
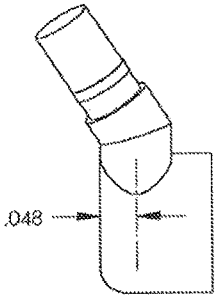
Figure 41A:
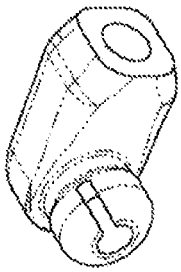
FIGS. 41A-E show multiple views of an upper arm or shoulder component.
Figure 41C:
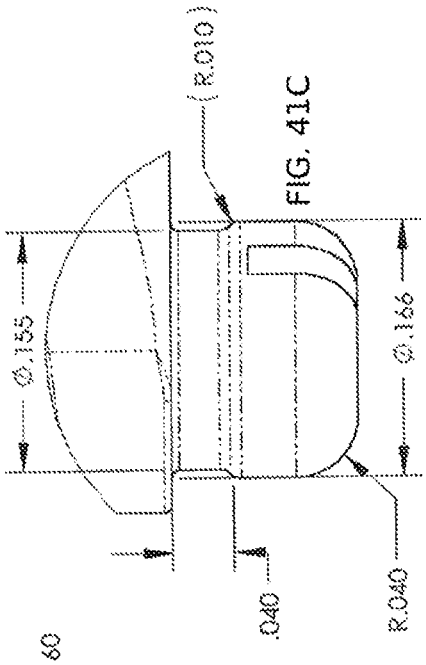
Figure 41E:
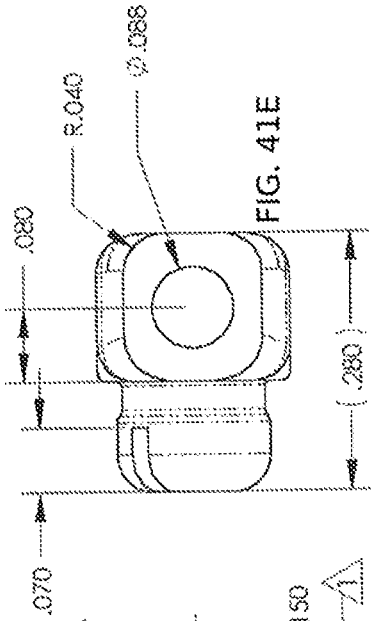
Figure 41B:
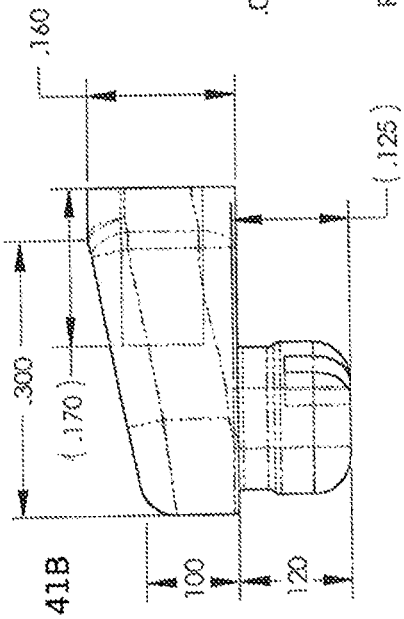
Figure 41D:
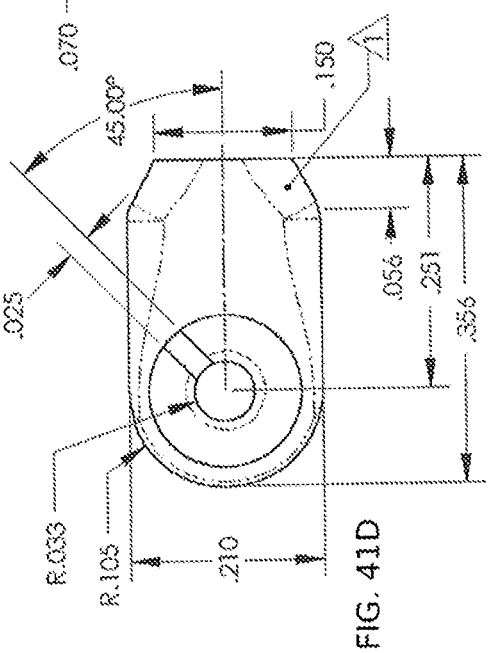
Figure 42B:
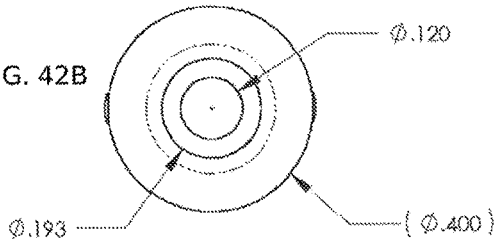
FIGS. 42A-F show multiple views of a head component.
Figure 42F:
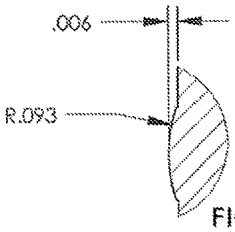
Figure 42A:
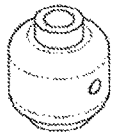
Figure 42C:
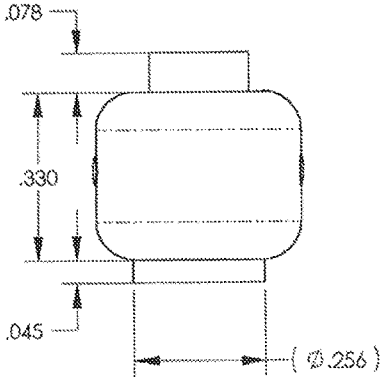
Figure 42D:
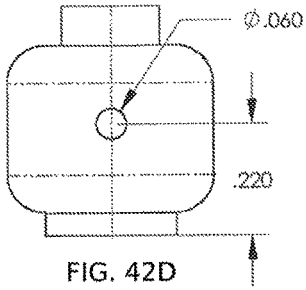
Figure 42E:
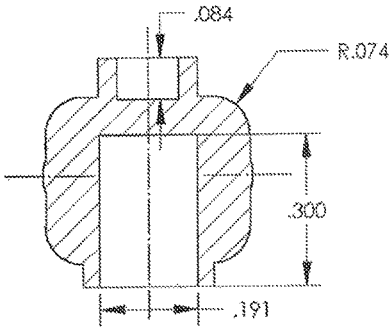
Figure 43B:
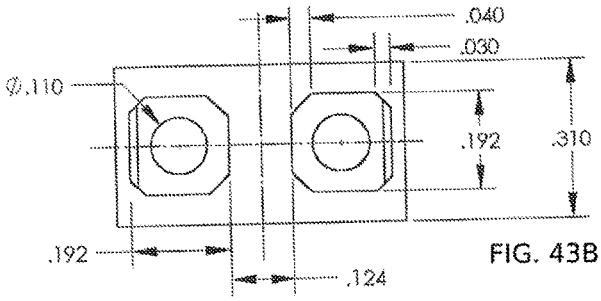
FIGS. 43A-D show multiple views of a hip component.
Figure 43A:
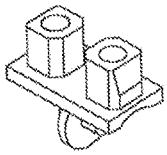
Figure 43C:
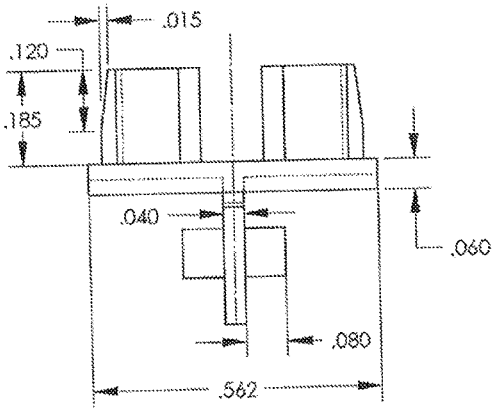
Figure 43D:
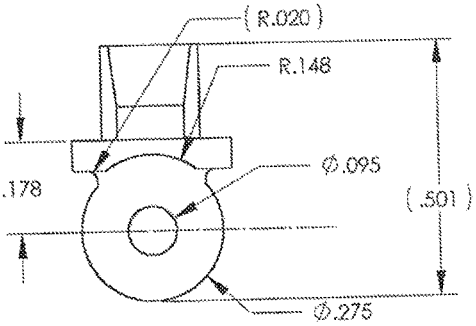
Figure 44B:
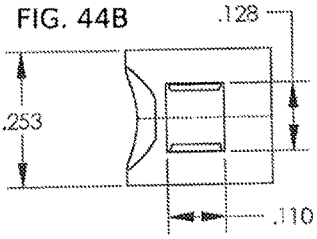
FIGS. 44A-F show multiple views of a left leg component.
Figure 44C:
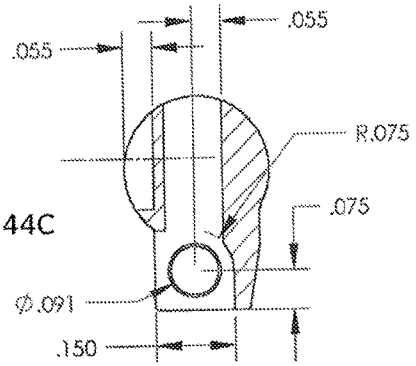
Figure 44A:
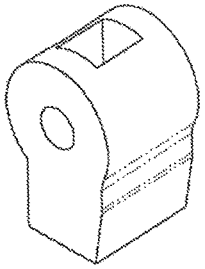
Figure 44D:
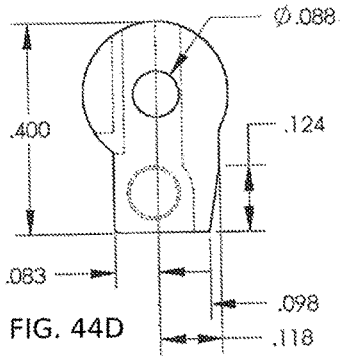
Figure 44E:
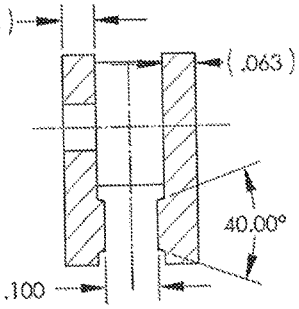
Figure 44F:
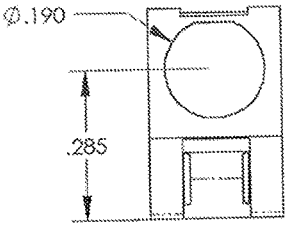
Figure 45A:
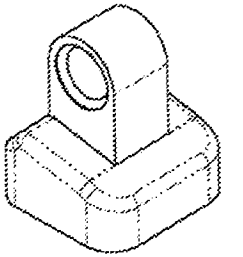
FIGS. 45A-F show multiple views of a foot component.
Figure 45B:
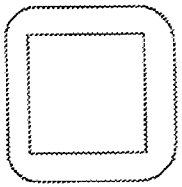
Figure 45E:
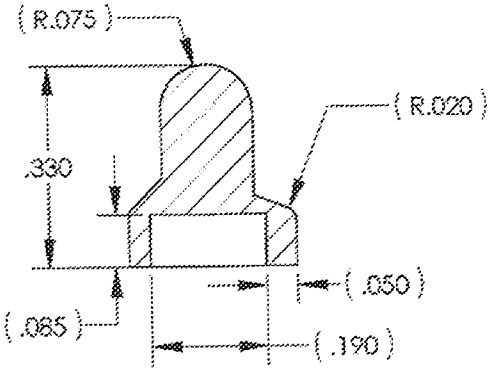
Figure 45F:
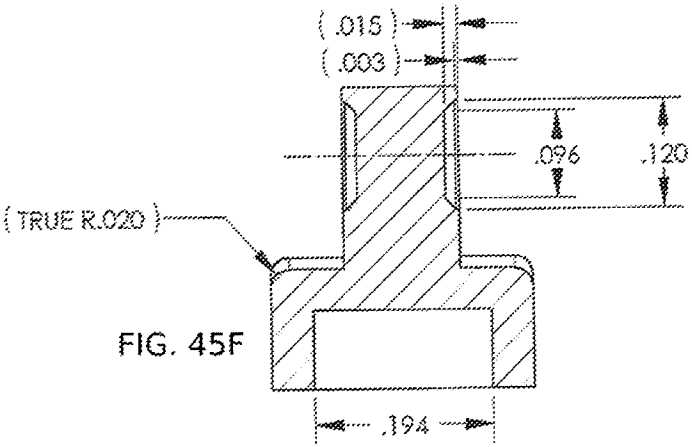
Figure 45D:
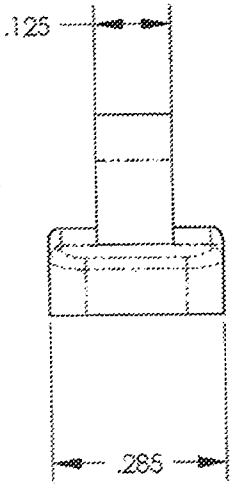
Figure 45C:
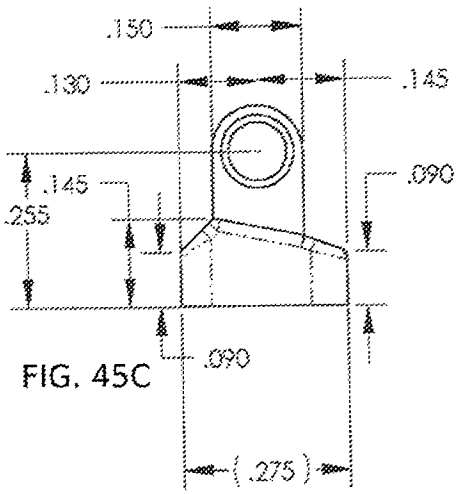
Figure 46A:
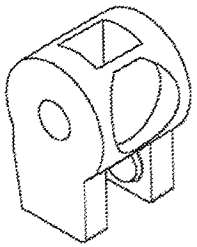
FIGS. 46A-E show multiple views of a right leg component.
Figure 46E:
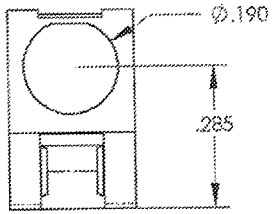
Figure 46D:
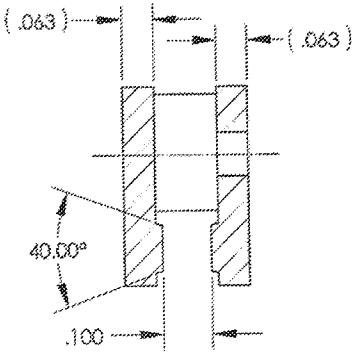
Figure 46B:
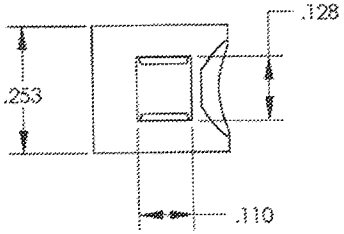
Figure 46C:
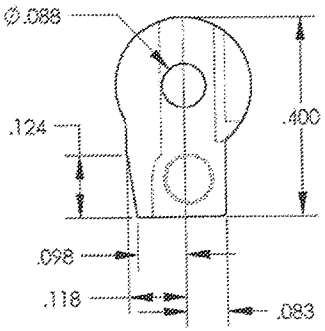
Figure 48B:
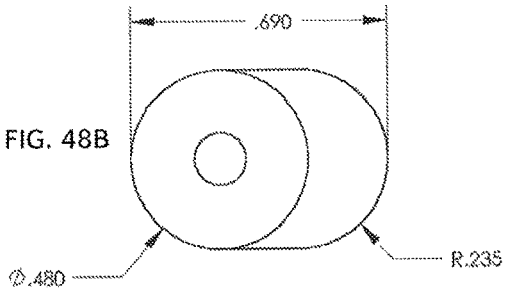
FIGS. 48A-F show multiple views of a hat accessory.
Figure 48A:
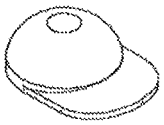
Figure 48F:
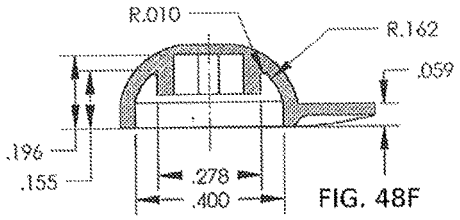
Figure 48C:
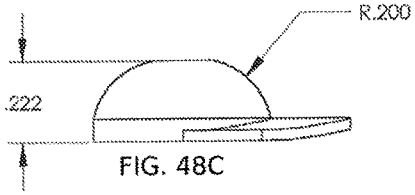
Figure 48E:
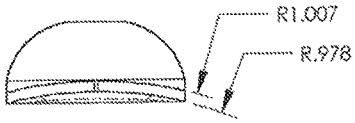
Figure 48D:
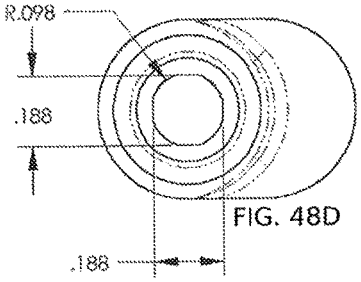
Figure 49B:
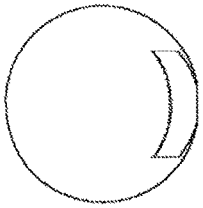
FIGS. 49A-E show multiple views of a ball accessory.
Figure 49E:
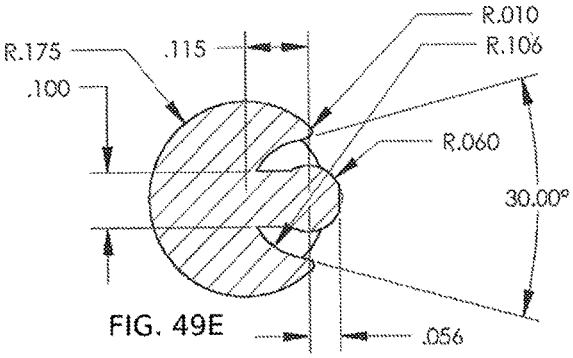
Figure 49A:
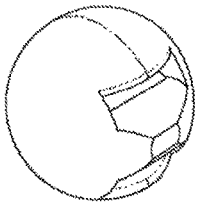
Figure 49C:
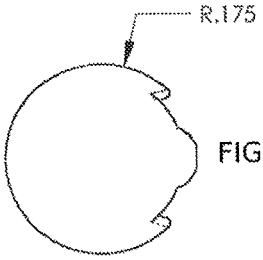
Figure 49D:
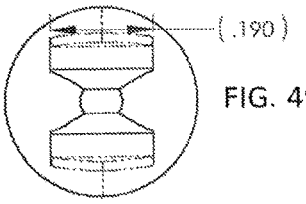
Figure 50A:
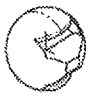
FIGS. 50A-D show multiple views of an alternative ball accessory.
Figure 50B:
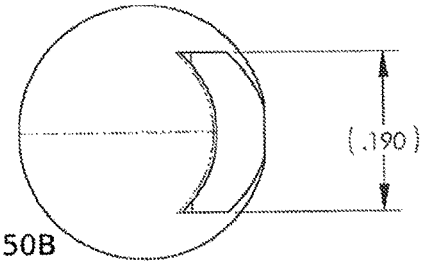
Figure 50D:
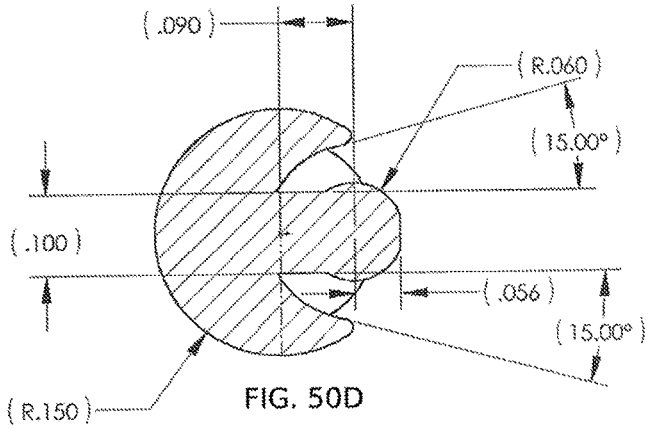
Figure 50C:
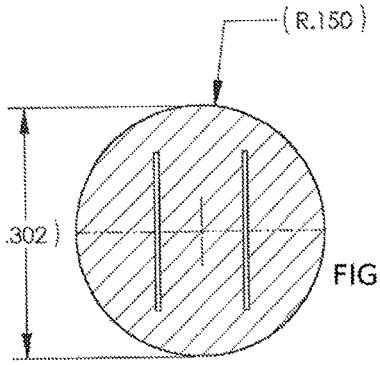
Figure 51A:
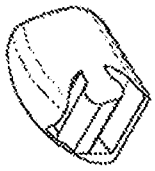
FIGS. 51A-E show multiple views of a baseball glove accessory.
Figure 51E:
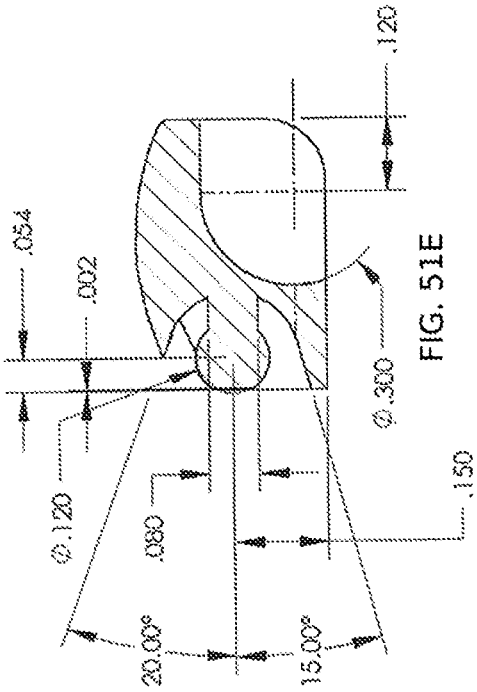
Figure 51D:
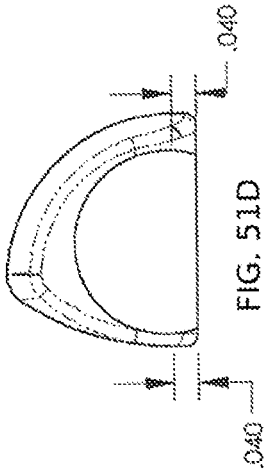
Figure 51B:
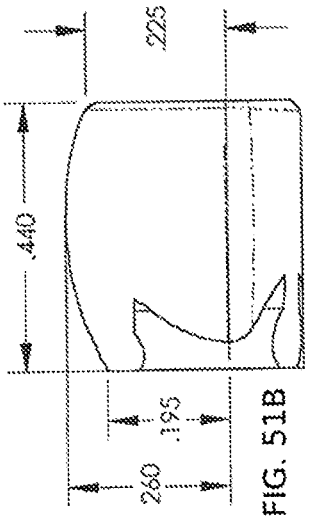
Figure 51C:
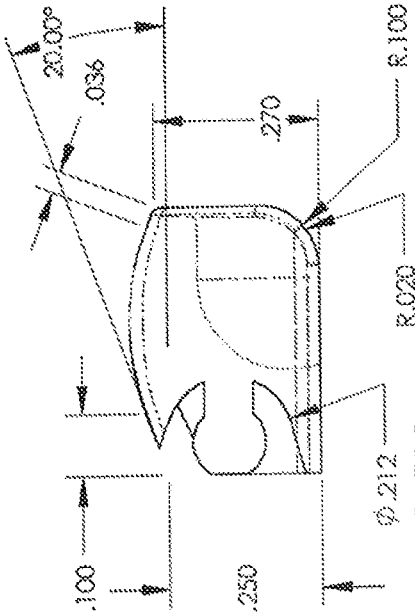
Figure 52:
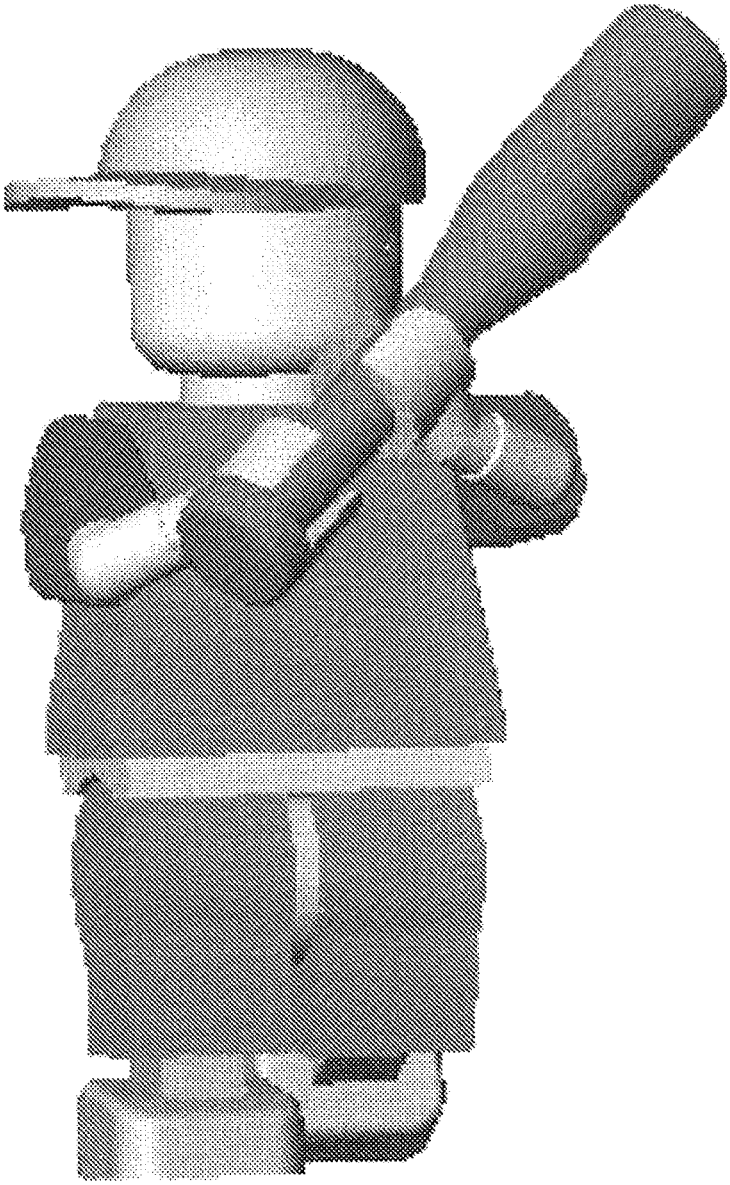
FIG. 52 shows a front view of a baseball mini-figure holding a bat.
Figure 53:
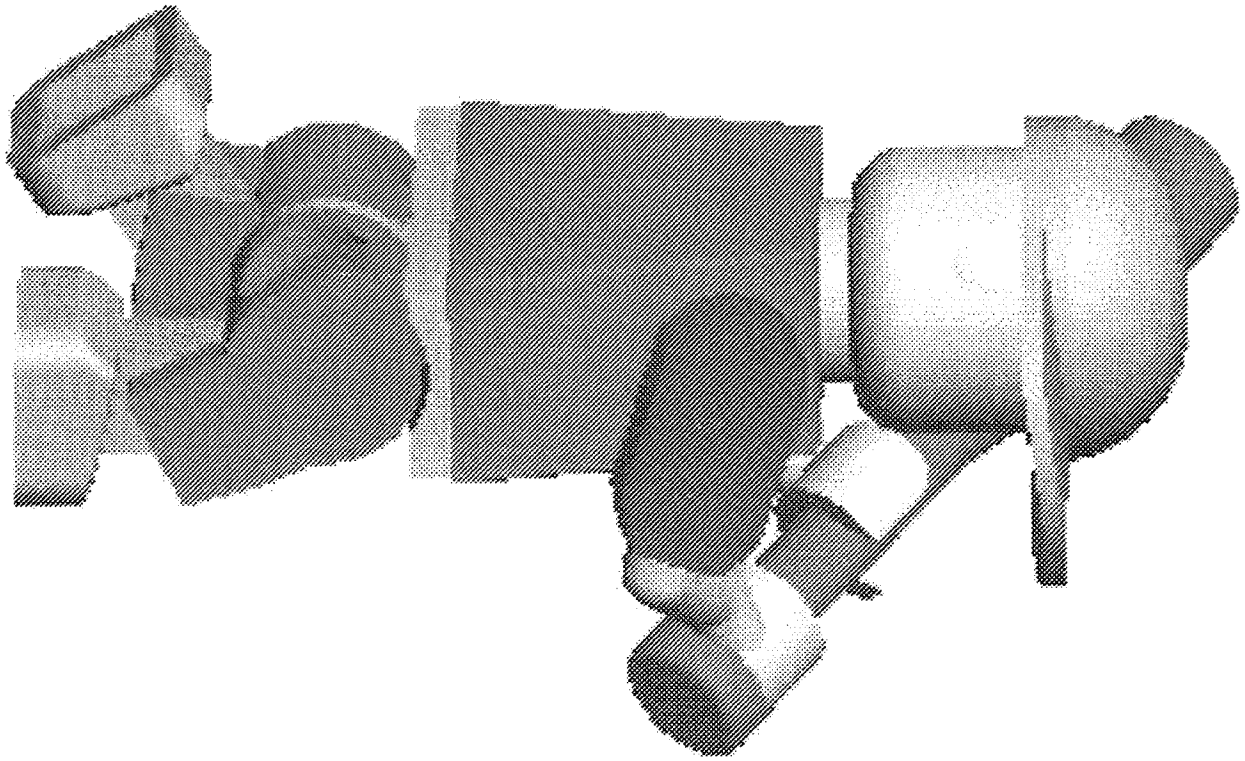
FIG. 53 shows a side view of a baseball mini-figure holding a bat.
Figure 54:
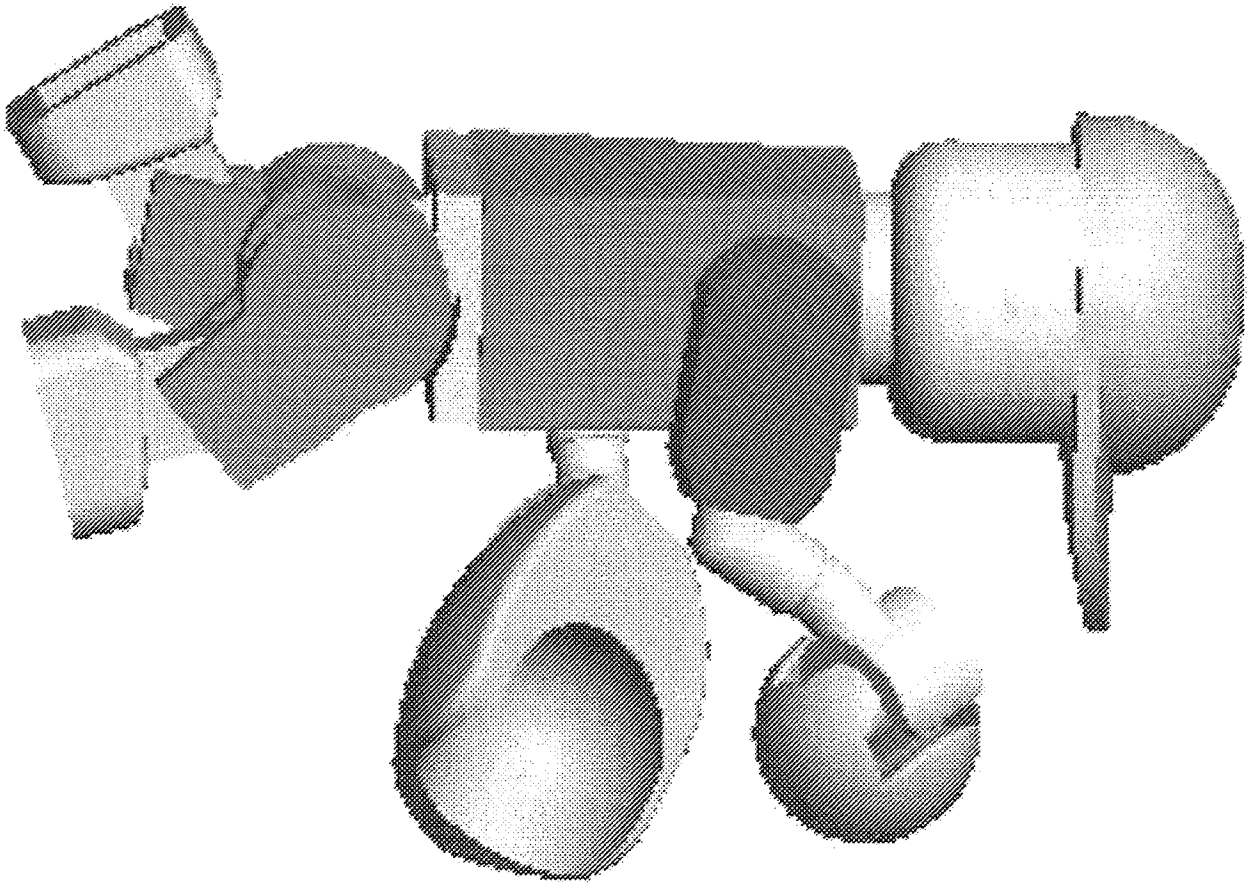
FIG. 54 shows a side view of a baseball mini-figure holding a glove and a ball.
Figure 55:
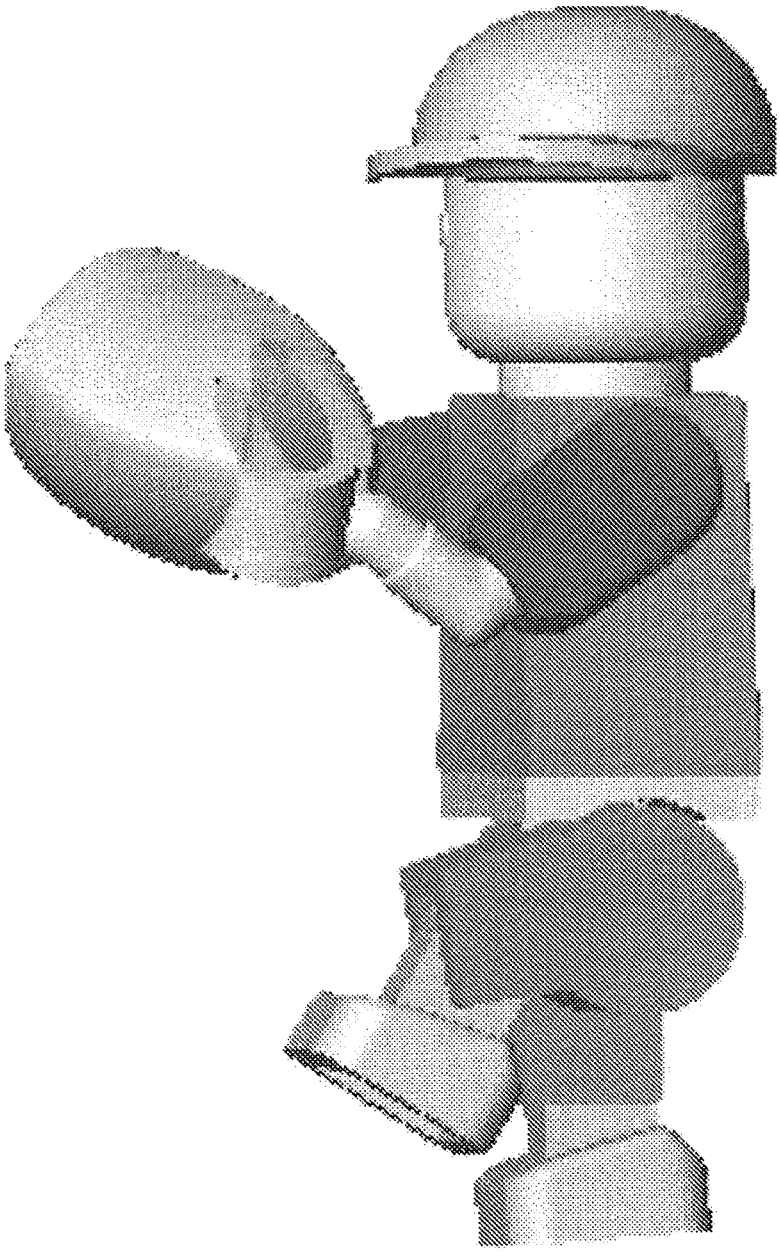
FIG. 55 shows a side view of a baseball mini-figure with glove in a pitching position.
Figure 56:
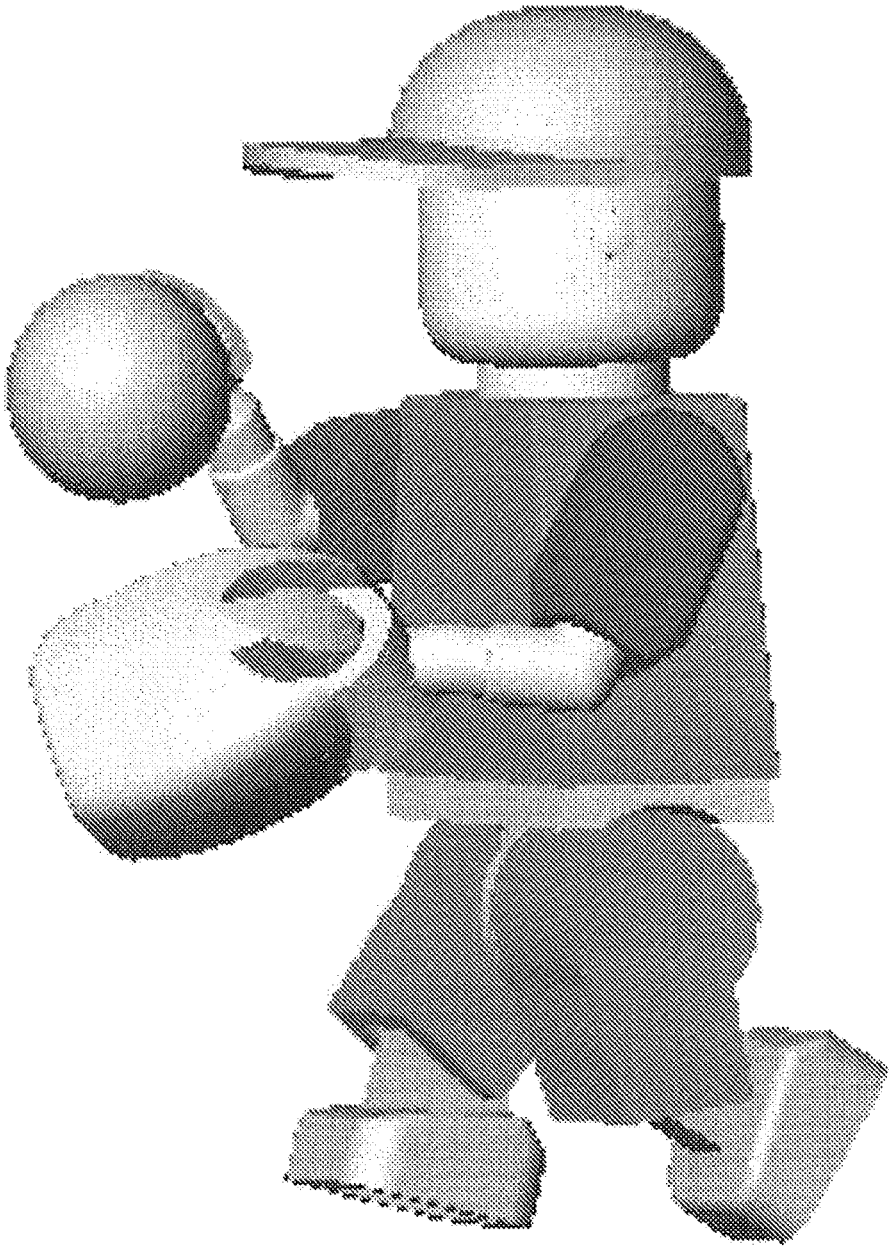
FIG. 56 shows a front view of a baseball mini-figure holding a glove and ball and in a throwing position.
Figure 57:
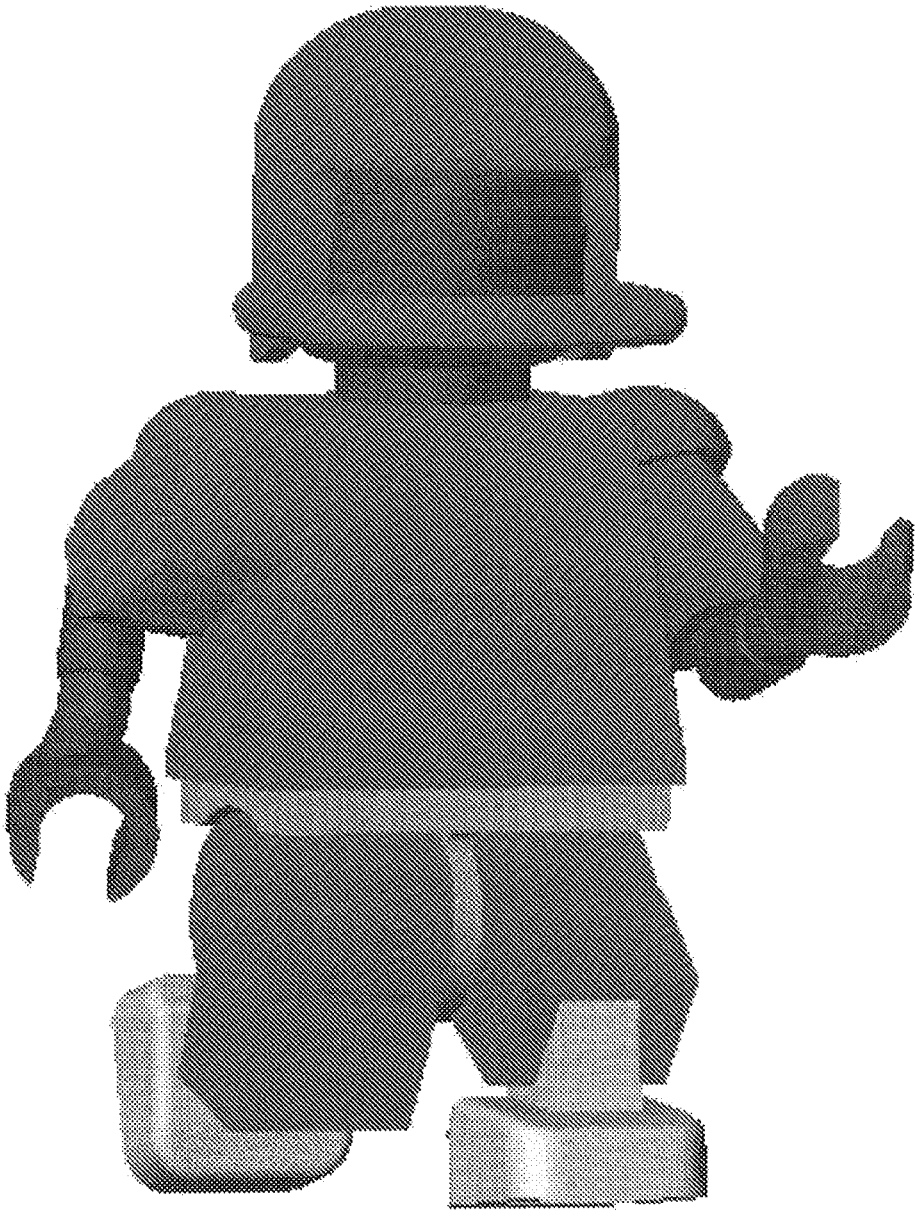
FIG. 57 shows a football mini-figure.
Figure 58B:
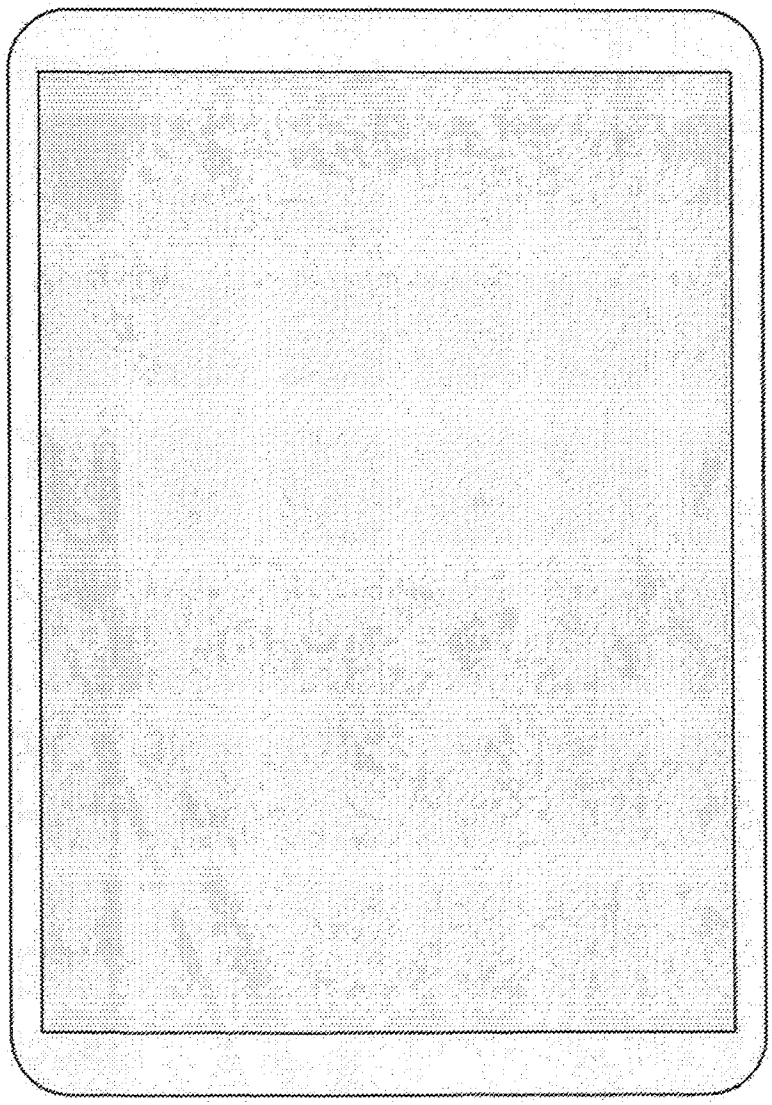
FIGS. 58A-B show packaging for a mini-figure sales display case, with visible card having a display side, FIG. 58A, and a back side, FIG. 58B.
Figure 58A:
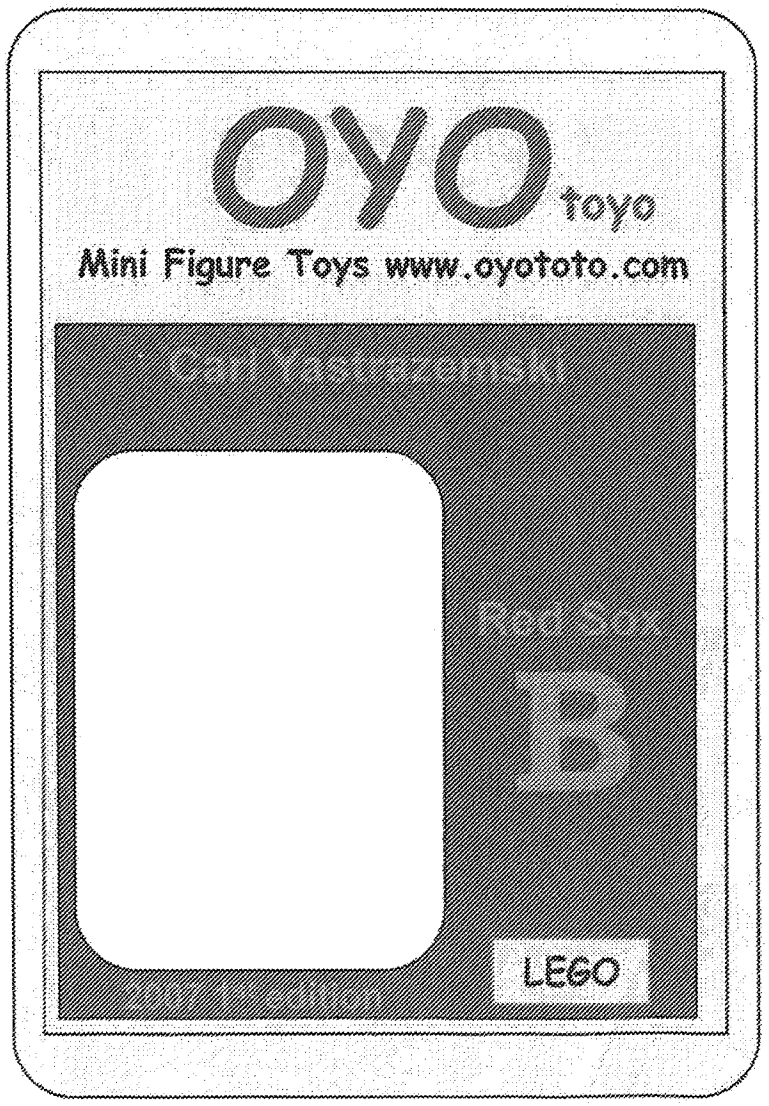
Figure 59:
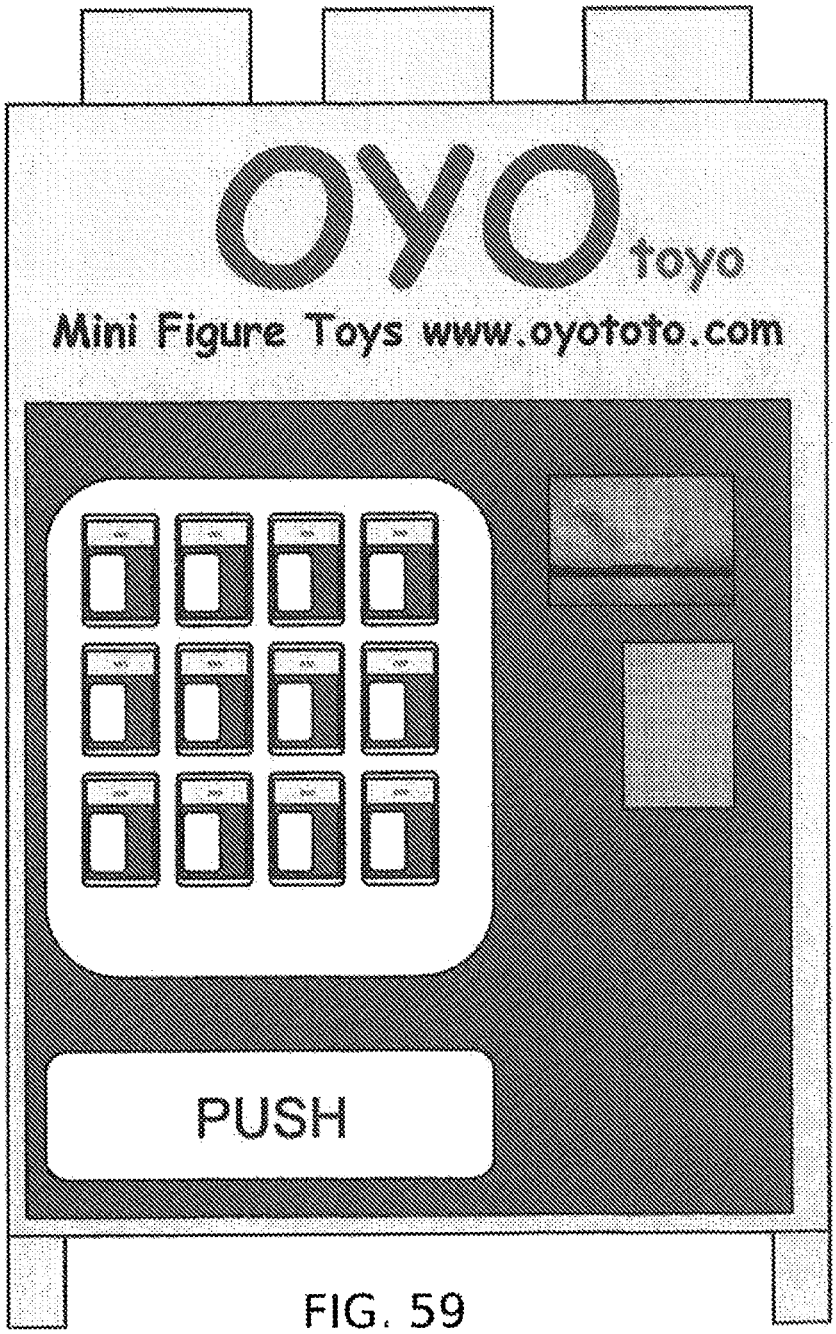
FIG. 59 shows a vending machine for mini-figures.
Figure 61A:
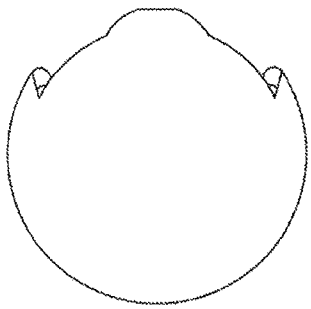
FIGS. 61A-C show multiple perspective views of a ball accessory.
Figure 61B:
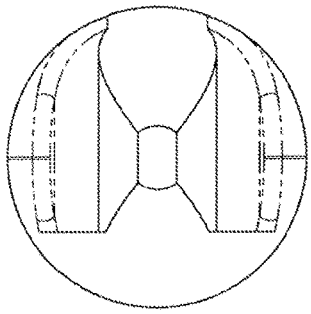
Figure 61C:
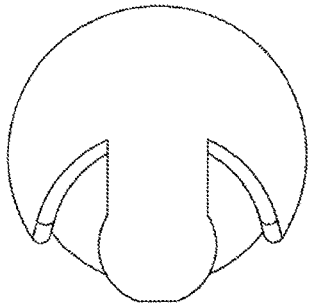
Figure 62B:
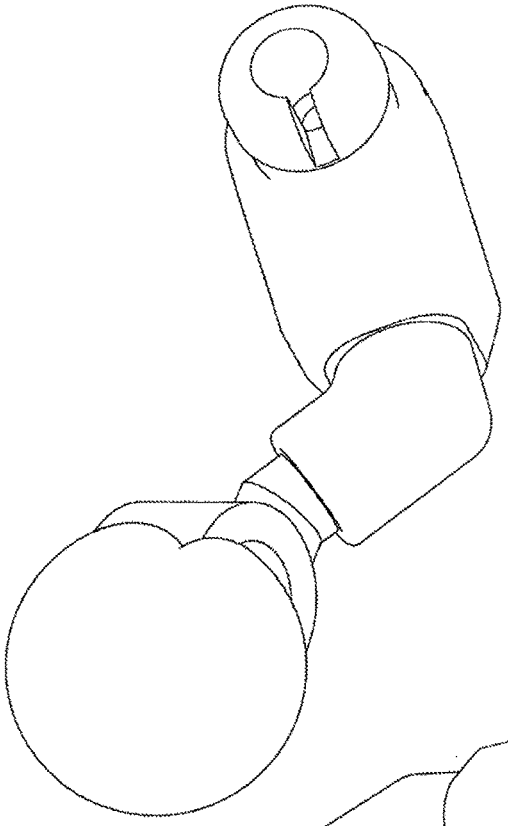
FIGS. 62A-B show multiple views of a multi-component arm connected to a ball.
Figure 62A:
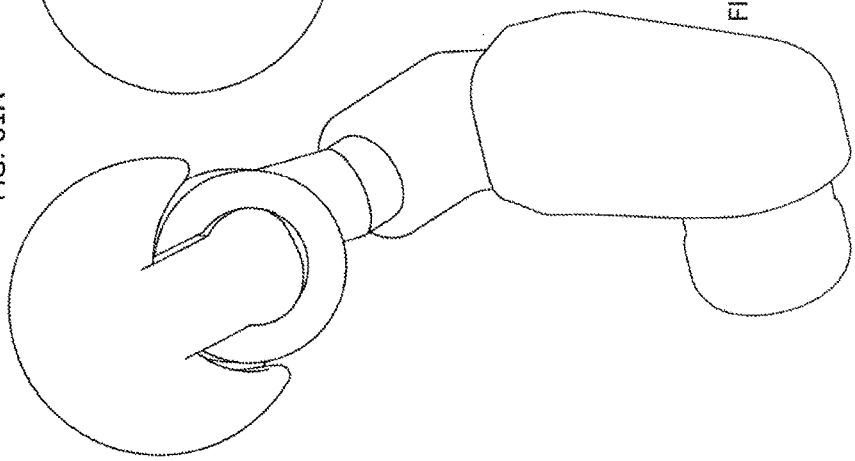
Figure 63A:
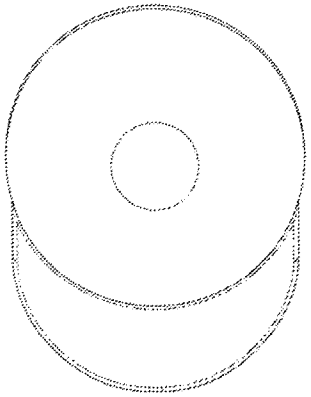
FIGS. 63A-G show multiple perspective views of a hat accessory.
Figure 63B:
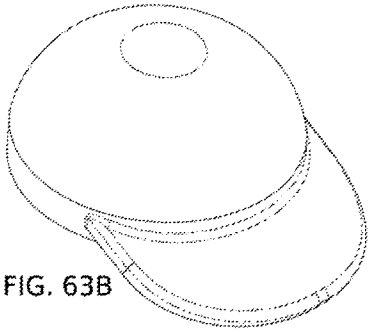
Figure 63C:
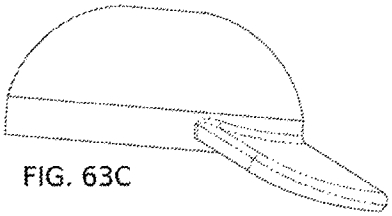
Figure 63D:
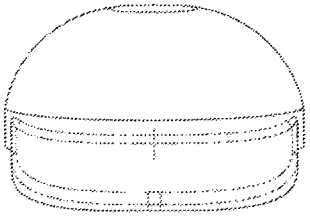
Figure 63E:
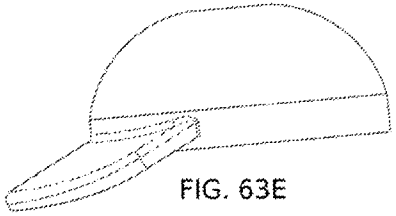
Figure 63F:
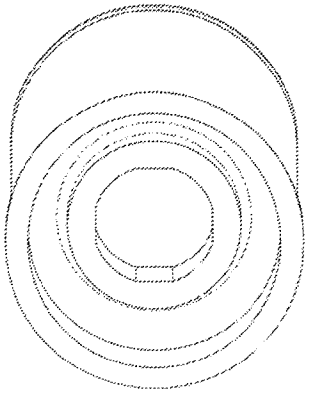
Figure 63G:
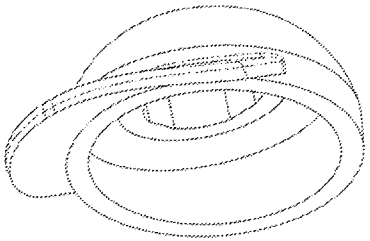
Figure 64A:
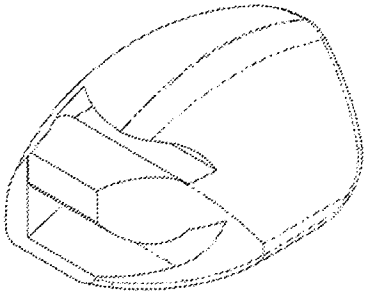
Figure 64B:
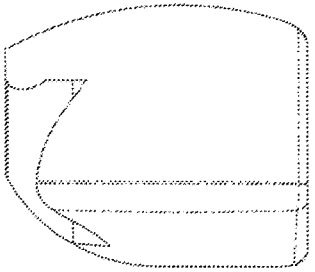
Figure 64C:
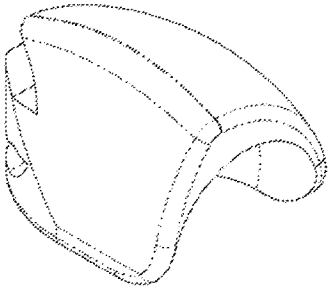
Figure 64D:
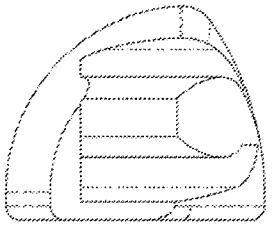
Figure 64E:
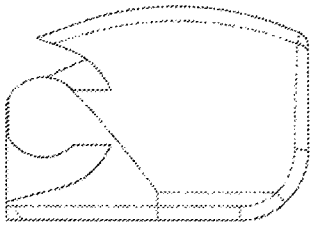
Figure 64F:
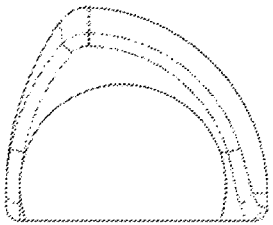
Figure 64G:
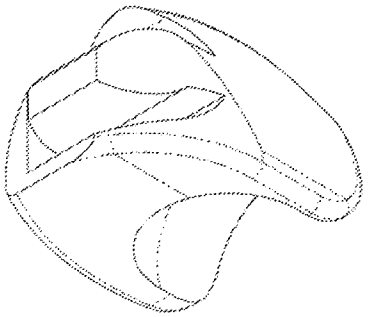
Figure 64H:
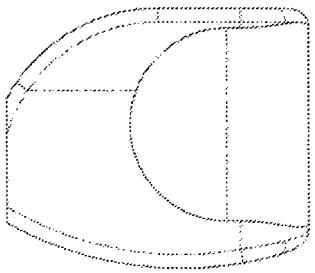
Figure 64I:
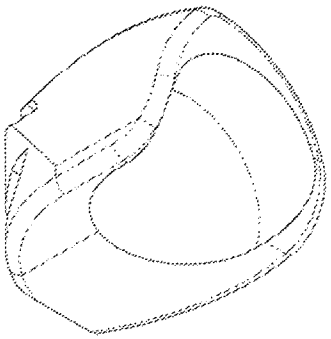
Figure 65A:
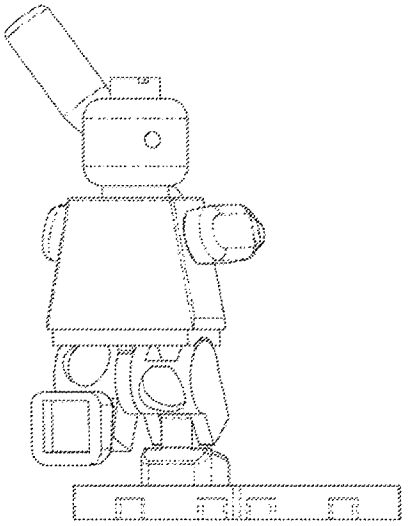
FIGS. 65A-E show multiple perspective views of a baseball mini-figure holding a bat and standing on a baseball plate with standard block tabs for connectors.
Figure 65B:
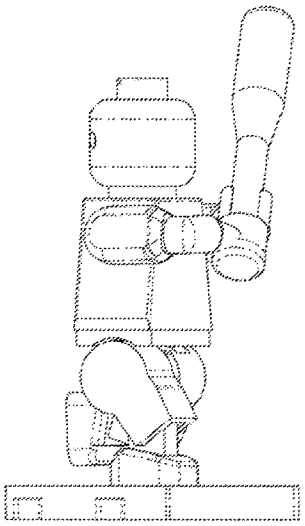
Figure 65C:
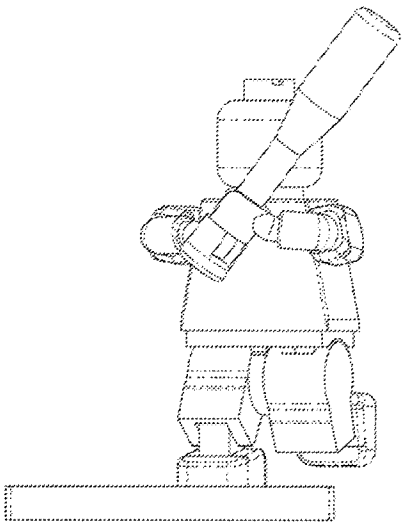
Figure 65D:
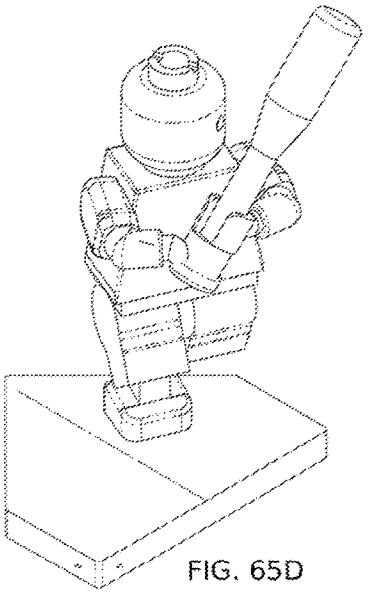
Figure 65E:
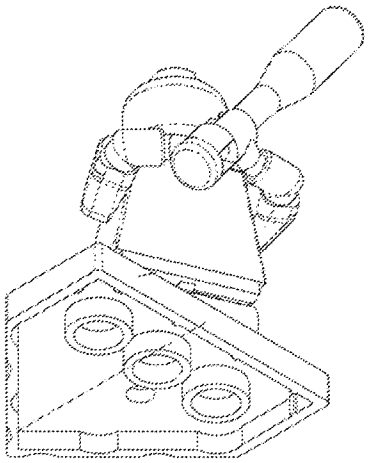

Referring also to FIG. 8, specific features of individual athletes, such as facial features, uniform numbers, name, or statistics may be included on individual components. This allows identifying each individual component with a specific player represented by a mini-figure. An unique number or serial number may be included for collectability purposes. Referring also to FIGS. 36 and 37, such marking may be done using a printer that prints directly on components and may be done individually, as a set, or on assembled mini-figures. The printer may have a tray for holding at least one figure allowing the components to be marked as a serialized set. This may also allow an array of figures to be printed during the same print with or without any variations in the array. For example, components may be arranged by sports team and skin tone, configured in an array of trays and printed in batches allowing rapid change and reproduction during a sports season. Alternatively, an individualized printer may hold one mini-figure having specific team markings. A user interface may select name and number to print on the specific mini-figure. Such customization may be done at a manufacturing facility, or at an end-sales location such as a store controlled by a purchaser or sales attendant.

Figure 24A:
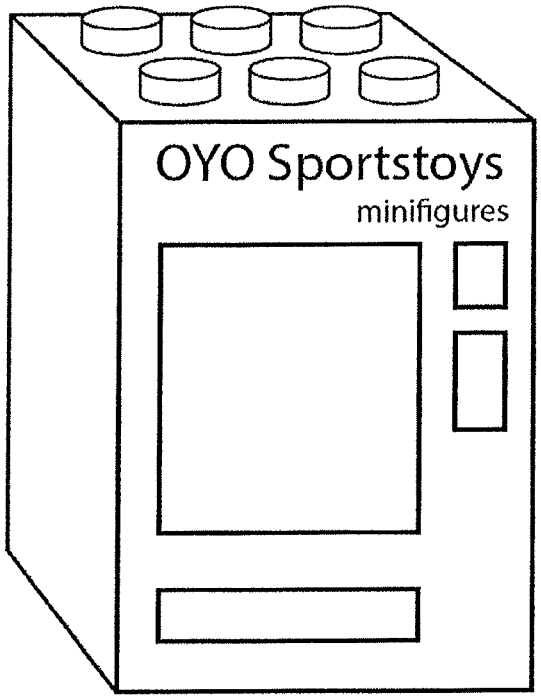
FIG. 24A shows a vending machine and FIG. 24B shows a point-of-purchase display.
Figure 24B:
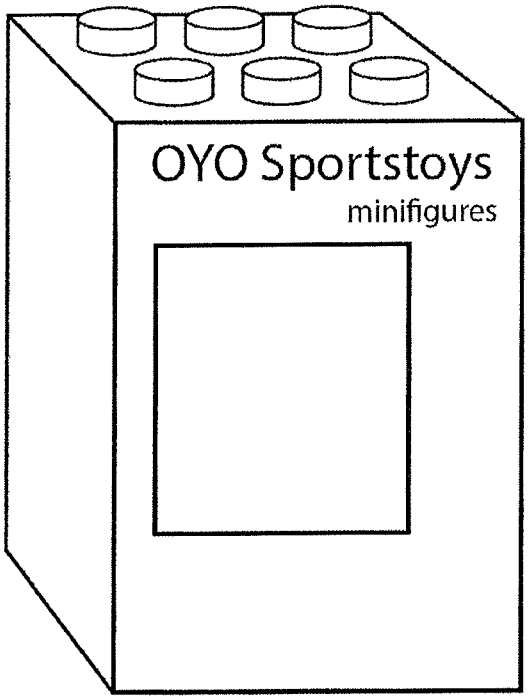
Figure 25:
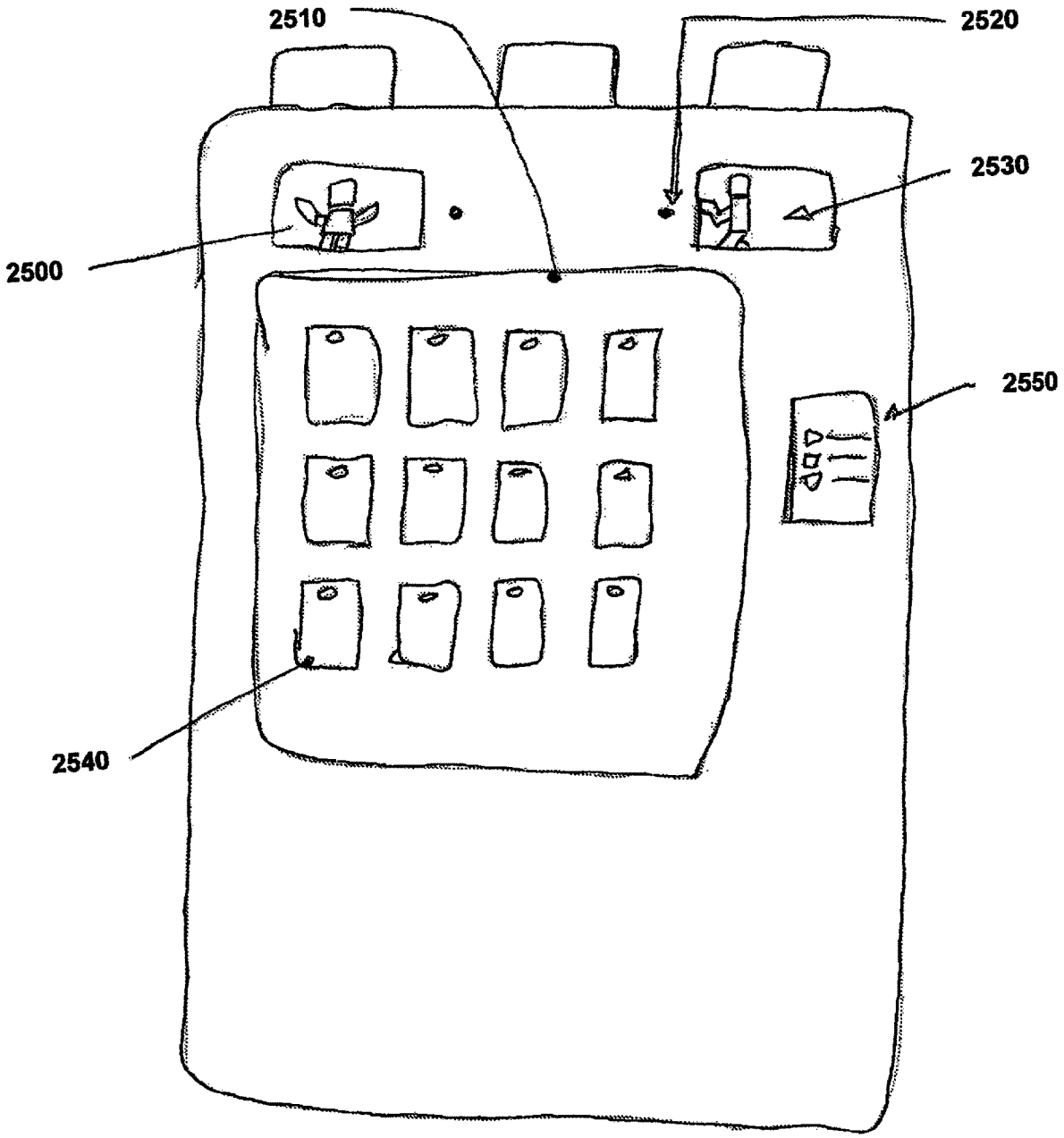
FIG. 25 shows a vending machine with interactive display.

In addition to customization by end-purchasers, referring also to FIGS. 24 and 25 another method to better enable the distribution of the mini-figures is to provide an easily identifiable display. Such display may include a housing structure for organizing packaged mini-figures and an interactive interface to attract customers. The interface may be motion sensitive to direct audio to customers passing by. The audio may be preprogrammed or instant communication fed through wireless or remote locations. As shown in FIG. 25, a mini-figure may be displayed 2500 with audio output as discussed above, such as saying "HEY! Let me out of here!" or "Welcome to the Boladrome!" Motion sensor 2520 may detect when anyone approaches, triggering the audio. RFID sensor 2510 may detect when mini-figures are purchased, with RFID 2540 included in each mini-figure package. Interactive display 2530 is programmable for different modes to interact with customers, including web-linked ads. Interactive access panel 2550 allows customer interaction, and may include web access to allow search and inventory listings of both the local machine and other machines or displays accessible via the web. An alternative sales display is a matrixed vending machine. This allows a customer to select a player mini-figure and purchase without requiring a store location. The interactive display may be incorporated into the vending machine. The vending machine may be transmit sales and inventory information to a web server allowing online inventory search by owners or customers to identify available mini-figures at specific locations.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

The invention claimed is:

1. A toy figurine comprising:

feet configured to connect to a lower portion of the toy figurine, a torso component, an arm component connected to the torso component, the arm component movable relative to the torso component, and a hand connected to the arm component and spaced apart from the torso component, the hand including a first recess, wherein the arm component comprises an upper arm component having a first cylindrical first portion received in a first opening of the torso component, the upper arm component movable relative to the torso component about a first rotational axis defined by the centerline of the first opening of the torso component, the upper arm component including a second opening positioned such that the centerline of the second opening of the upper arm component intersects the centerline of the first opening of the torso component; and a forearm component having a second cylindrical first portion received in the second opening of the upper arm component, the forearm component movable about a second rotational axis defined by the centerline of the second opening of the upper arm component, the forearm component including a third opening positioned such that the centerline of the third opening of the forearm component intersects the centerline of the second opening of the upper arm component;

wherein the hand has a third cylindrical first portion received in the third opening of the forearm component such that the hand is extendable along the centerline of the third opening of the forearm; and wherein movement of the forearm component along the centerline of the second opening of the upper arm component changes the distance between the torso component and the hand component.

2. The toy figurine of claim 1, wherein the toy figurine includes a first upper leg component and a second upper leg component, each upper leg component configured to pivot relative to the torso component.

3. The toy figurine of claim 2, wherein the second cylindrical first portion of the forearm component has a cylindrical post and a cylindrical band on said post, the cylindrical post having a first forearm diameter and the cylindrical band having a second forearm diameter larger than the first, the second forearm diameter being larger than a diameter of the second opening of the upper arm component.

4. The toy figurine of claim 3, wherein the third cylindrical first portion of the hand has a cylindrical post and a cylindrical band on said post, the cylindrical post having a first hand diameter and the cylindrical band having a second hand diameter larger than the first, the second hand diameter being larger than a diameter of the third opening of the forearm component.

5. The toy figurine of claim 4, wherein the hand includes a cylindrical recession positioned distally from the cylindrical post of the hand component such that rotation of the hand component causes the cylindrical recession to revolve.

6. The toy figurine of claim 1, wherein the second cylindrical first portion of the forearm component has a cylindrical post and a cylindrical band on said post, the cylindrical post having a first forearm diameter and the cylindrical band having a second forearm diameter larger than the first, the second forearm diameter being larger than a diameter of the second opening of the upper arm component.

7. The toy figurine of claim 1, wherein the third cylindrical first portion of the hand has a cylindrical post and a cylindrical band on said post, the cylindrical post having a first hand diameter and the cylindrical band having a second hand diameter larger than the first, the second hand diameter being larger than a diameter of the third opening of the forearm component.

8. The toy figurine of claim 1, further comprising a removable component shaped like an implement used in a sport, the removable component including a second recess, wherein the second recess of the removable component receives a portion of the hand and the first recess of the hand receives a portion of the removable component so that the removable component is engageable with the hand through an interference fit.

9. The toy figurine of claim 1, further comprising a head component configured to connect to the torso component.

10. The toy figurine of claim 9, further comprising a hat component configured to connect to the head component.

11. The toy figurine of claim 9, wherein the head component is rotatable relative to the torso component.

12. The toy figurine of claim 9, wherein the head component includes a face.

13. The toy figurine of claim 12, wherein the face includes facial hair.

* * * * *